US008464812B2

(12) United States Patent
Radford et al.

(10) Patent No.: US 8,464,812 B2
(45) Date of Patent: Jun. 18, 2013

(54) REMOTELY CONTROLLED APPARATUS FOR DOWNHOLE APPLICATIONS AND RELATED METHODS

(75) Inventors: Steven R. Radford, The Woodlands, TX (US); S. Richard Gentry, The Woodlands, TX (US); Johannes Witte, Braunschweig (DE)

(73) Assignee: Baker Hughes Incorporated, Houston, TX (US)

( * ) Notice: Subject to any disclaimer, the term of this patent is extended or adjusted under 35 U.S.C. 154(b) by 6 days.

(21) Appl. No.: 13/252,644

(22) Filed: Oct. 4, 2011

(65) Prior Publication Data

US 2012/0080231 A1 Apr. 5, 2012

Related U.S. Application Data

(63) Continuation of application No. 13/169,743, filed on Jun. 27, 2011.

(60) Provisional application No. 61/389,578, filed on Oct. 4, 2010, provisional application No. 61/412,911, filed on Nov. 12, 2010.

(51) Int. Cl.
*E21B 10/32* (2006.01)

(52) U.S. Cl.
USPC ..... 175/269; 175/57; 166/383

(58) Field of Classification Search
USPC ..... 166/383, 55.8, 212, 321; 137/115.08; 175/57, 98, 99, 258, 267, 269
See application file for complete search history.

(56) References Cited

U.S. PATENT DOCUMENTS

| | | | | | |
|---|---|---|---|---|---|
| 2,136,518 | A | * | 11/1938 | Nixon | 166/55.8 |
| 2,328,840 | A | * | 9/1943 | O'Leary | 166/208 |
| 2,532,418 | A | * | 12/1950 | Page | 166/212 |
| 2,874,784 | A | * | 2/1959 | Baker et al. | 166/212 |
| 2,922,627 | A | * | 1/1960 | Kammerer | 166/55.8 |
| 3,011,558 | A | * | 12/1961 | Conrad | 166/212 |
| 3,083,765 | A | * | 4/1963 | Kammerer | 166/290 |
| 3,171,502 | A | * | 3/1965 | Kammerer | 175/267 |
| 3,283,834 | A | * | 11/1966 | Kammerer | 175/267 |
| 3,289,760 | A | * | 12/1966 | Kammerer | 166/290 |
| 3,351,134 | A | * | 11/1967 | Kammerer, Jr. | 166/55.8 |
| 4,067,388 | A | * | 1/1978 | Mouret et al. | 166/208 |
| 4,574,883 | A | * | 3/1986 | Carroll et al. | 166/255.1 |
| 4,776,394 | A | * | 10/1988 | Lynde et al. | 166/55.8 |

(Continued)

OTHER PUBLICATIONS

International Search Report for International Application No. PCT/US2011/054734 mailed Apr. 25, 2012, 4 pages.

(Continued)

*Primary Examiner* — David Bagnell
*Assistant Examiner* — Blake Michener
(74) *Attorney, Agent, or Firm* — TraskBritt

(57) ABSTRACT

An expandable apparatus may comprise a tubular body, a valve piston and a push sleeve. The tubular body may comprise a fluid passageway extending therethrough, and the valve piston may be disposed within the tubular body, the valve piston configured to move axially within the tubular body responsive to a pressure of drilling fluid passing through the fluid passageway and configured to selectively control a flow of fluid into an annular chamber. The push sleeve may be disposed within the tubular body and coupled to at least one expandable feature, the push sleeve configured to move axially responsive to a flow of fluid into the annular chamber extending the at least one expandable feature.

17 Claims, 17 Drawing Sheets

U.S. PATENT DOCUMENTS

| | | | | |
|---|---|---|---|---|
| 4,893,675 | A * | 1/1990 | Skipper | 166/55.8 |
| 4,938,291 | A * | 7/1990 | Lynde et al. | 166/55.8 |
| 4,971,146 | A * | 11/1990 | Terrell | 166/55 |
| 5,018,580 | A * | 5/1991 | Skipper | 166/298 |
| 5,101,895 | A * | 4/1992 | Gilbert | 166/55.8 |
| 5,168,933 | A * | 12/1992 | Pritchard, Jr. et al. | 166/348 |
| 5,311,954 | A * | 5/1994 | Quintana | 175/61 |
| 5,788,000 | A * | 8/1998 | Maury et al. | 175/325.1 |
| 5,791,409 | A * | 8/1998 | Flanders | 166/55.8 |
| 5,862,870 | A * | 1/1999 | Hutchinson | 175/269 |
| 6,173,795 | B1 * | 1/2001 | McGarian et al. | 175/231 |
| 6,213,206 | B1 * | 4/2001 | Bakke | 166/242.7 |
| 6,263,969 | B1 * | 7/2001 | Stoesz et al. | 166/334.4 |
| 6,289,999 | B1 | 9/2001 | Dewey et al. | |
| 6,378,612 | B1 * | 4/2002 | Churchill | 166/319 |
| 6,439,305 | B1 * | 8/2002 | Bakke | 166/242.6 |
| 6,615,933 | B1 * | 9/2003 | Eddison | 175/284 |
| 6,681,860 | B1 * | 1/2004 | Yokley et al. | 166/382 |
| 6,732,817 | B2 | 5/2004 | Dewey et al. | |
| 6,854,521 | B2 * | 2/2005 | Echols et al. | 166/387 |
| 6,857,473 | B2 * | 2/2005 | Cook et al. | 166/212 |
| 6,889,771 | B1 * | 5/2005 | Leising et al. | 166/373 |
| 6,978,844 | B2 * | 12/2005 | LaFleur | 166/386 |
| 7,036,611 | B2 | 5/2006 | Radford et al. | |
| 7,308,937 | B2 | 12/2007 | Radford et al. | |
| 7,357,198 | B2 | 4/2008 | McGarian et al. | |
| 7,383,881 | B2 * | 6/2008 | Telfer | 166/212 |
| 7,886,834 | B2 * | 2/2011 | Spencer et al. | 166/382 |
| 7,900,717 | B2 * | 3/2011 | Radford et al. | 175/269 |
| 8,028,767 | B2 * | 10/2011 | Radford et al. | 175/269 |
| 8,069,916 | B2 * | 12/2011 | Giroux et al. | 166/212 |
| 8,074,747 | B2 * | 12/2011 | Radford et al. | 175/325.7 |
| 2007/0246217 | A1 * | 10/2007 | Tulloch et al. | 166/311 |
| 2008/0128169 | A1 * | 6/2008 | Radford et al. | 175/57 |
| 2008/0128175 | A1 * | 6/2008 | Radford et al. | 175/269 |
| 2009/0032308 | A1 | 2/2009 | Eddison | |
| 2009/0044944 | A1 * | 2/2009 | Murray et al. | 166/308.1 |
| 2009/0145666 | A1 * | 6/2009 | Radford et al. | 175/269 |
| 2009/0266544 | A1 | 10/2009 | Redlinger et al. | |
| 2010/0089583 | A1 | 4/2010 | Xu et al. | |
| 2010/0224414 | A1 * | 9/2010 | Radford et al. | 175/57 |
| 2010/0288557 | A1 * | 11/2010 | Radford | 175/57 |
| 2011/0005836 | A1 * | 1/2011 | Radford et al. | 175/57 |
| 2011/0073330 | A1 * | 3/2011 | Radford | 166/387 |
| 2011/0073371 | A1 * | 3/2011 | Radford | 175/57 |
| 2011/0073376 | A1 * | 3/2011 | Radford et al. | 175/269 |
| 2011/0127044 | A1 * | 6/2011 | Radford et al. | 166/373 |
| 2011/0203849 | A1 * | 8/2011 | Radford et al. | 175/57 |
| 2011/0266060 | A1 * | 11/2011 | Radford et al. | 175/57 |
| 2011/0308861 | A1 * | 12/2011 | Radford | 175/57 |
| 2012/0048571 | A1 * | 3/2012 | Radford et al. | 166/373 |

OTHER PUBLICATIONS

International Search Report for International Application No. PCT/US2011/054692 mailed May 7, 2012, 4 pages.

International Search Report for International Application No. PCT/US2010/050933 mailed May 9, 2011, 3 pages.

International Written Opinion for International Application No. PCT/US2010/050933 mailed May 9, 2011, 3 pages.4 pages.

International Preliminary Report on Patentability for International Application No. PCT/US2010/050933 dated Apr. 3, 2012, 6 pages.

International Written Opinion for International Application No. PCT/US2011/054692 mailed May 7, 2012, 6 pages.

* cited by examiner

REMOTELY CONTROLLED APPARATUS FOR DOWNHOLE APPLICATIONS AND RELATED METHODS

CROSS-REFERENCE TO RELATED APPLICATIONS

This application is a continuation of U.S. patent application Ser. No. 13/169,743, filed Jun. 27, 2011, pending, which claims the benefit of U.S. Provisional Application Ser. No. 61/389,578, filed Oct. 4, 2010, entitled "STATUS INDICATORS FOR USE IN EARTH-BORING TOOLS HAVING EXPANDABLE MEMBERS AND METHODS OF MAKING AND USING SUCH STATUS INDICATORS AND EARTH-BORING TOOLS," and of U.S. Provisional Application Ser. No. 61/412,911, filed Nov. 12, 2010, entitled "REMOTELY CONTROLLED APPARATUS FOR DOWNHOLE APPLICATIONS AND RELATED METHODS," the disclosure of each of which is hereby incorporated herein by this reference in its entirety.

This application is related to U.S. patent application Ser. No. 12/895,233, filed Sep. 30, 2010, pending, entitled "REMOTELY CONTROLLED APPARATUS FOR DOWNHOLE APPLICATIONS AND METHODS OF OPERATION," which claims priority to U.S. Provisional Application Ser. No. 61/247,162, filed Sep. 30, 2009, entitled "REMOTELY ACTIVATED AND DEACTIVATED EXPANDABLE APPARATUS FOR EARTH BORING APPLICATIONS," and to U.S. Provisional Patent Application Ser. No. 61/377,146, filed Aug. 26, 2010, entitled "REMOTELY-CONTROLLED DEVICE AND METHOD FOR DOWNHOLE ACTUATION," the disclosure of each of which is hereby incorporated herein by this reference in its entirety.

TECHNICAL FIELD

Embodiments of the present invention relate generally to remotely controlled apparatus for use in a subterranean wellbore and components therefor. Some embodiments relate to an expandable reamer apparatus for enlarging a subterranean wellbore, some to an expandable stabilizer apparatus for stabilizing a bottom hole assembly during a drilling operation, and other embodiments to other apparatus for use in a subterranean wellbore, and in still other embodiments to an actuation device and system. Embodiments additionally relate to devices and methods for remotely detecting the operating condition of such remotely controlled apparatus.

BACKGROUND

Wellbores, also called boreholes, for hydrocarbon (oil and gas) production, as well as for other purposes, such as for example geothermal energy production, are drilled with a drill string that includes a tubular member (also referred to as a drilling tubular) having a drilling assembly (also referred to as the drilling assembly or bottom hole assembly or "BHA") which includes a drill bit attached to the bottom end thereof. The drill bit is rotated to shear or disintegrate material of the rock formation to drill the wellbore. The drill string often includes tools or other devices that need to be remotely activated and deactivated during drilling operations. Such tools and devices include, among other things, reamers, stabilizers or force application members used for steering the drill bit. Production wells include devices, such as valves, inflow control device, etc., that are remotely controlled. The disclosure herein provides a novel apparatus for controlling such devices and other downhole tools or devices.

Expandable tools are typically employed in downhole operations in drilling oil, gas and geothermal wells. For example, expandable reamers are typically employed for enlarging a subterranean wellbore. In drilling oil, gas, and geothermal wells, a casing string (such term broadly including a liner string) may be installed and cemented within the wellbore to prevent the wellbore walls from caving into the wellbore while providing requisite shoring for subsequent drilling operations to achieve greater depths. Casing also may be installed to isolate different formations, to prevent cross-flow of formation fluids, and to enable control of formation fluids and pressure as the borehole is drilled. To increase the depth of a previously drilled borehole, new casing is laid within and extended below the previously installed casing. While adding additional casing allows a borehole to reach greater depths, it has the disadvantage of narrowing the borehole. Narrowing the borehole restricts the diameter of any subsequent sections of the wellbore because the drill bit and any further casing must pass through the existing casing. As reductions in the borehole diameter are undesirable because they limit the production flow rate of oil and gas through the borehole, it is often desirable to enlarge a subterranean borehole to provide a larger borehole diameter for installing additional casing beyond previously installed casing as well as to enable better production flow rates through the wellbore. A variety of approaches have been employed for enlarging a borehole diameter. One conventional approach used to enlarge a subterranean borehole includes using eccentric and bi-center bits. For example, an eccentric bit with a laterally extended or enlarged cutting portion is rotated about its axis to produce an enlarged wellbore diameter. A bi-center bit assembly employs two longitudinally superimposed bit sections with laterally offset longitudinal axes, which produce an enlarged wellbore diameter when the bit is rotated.

Another conventional approach used to enlarge a subterranean wellbore includes employing an extended bottom-hole assembly with a pilot drill bit at the distal end thereof and a reamer assembly some distance above. This arrangement permits the use of any standard rotary drill bit type, be it a rock bit or a drag bit, as the pilot bit, and the extended nature of the assembly permits greater flexibility when passing through tight spots in the wellbore as well as the opportunity to effectively stabilize the pilot drill bit so that the pilot hole and the following reamer will traverse the path intended for the wellbore. This aspect of an extended bottom hole assembly is particularly significant in directional drilling. One design to this end includes so-called "reamer wings," which generally comprise a tubular body having a fishing neck with a threaded connection at the top thereof and a tong die surface at the bottom thereof, also with a threaded connection. The upper mid-portion of the reamer wing tool includes one or more longitudinally extending blades projecting generally radially outwardly from the tubular body, the outer edges of the blades carrying PDC cutting elements.

As mentioned above, conventional expandable reamers may be used to enlarge a subterranean wellbore and may include blades pivotably or hingedly affixed to a tubular body and actuated by way of a piston disposed therein. In addition, a conventional wellbore opener may be employed comprising a body equipped with at least two hole opening arms having cutting means that may be moved from a position of rest in the body to an active position by exposure to pressure of the drilling fluid flowing through the body. The blades in these reamers are initially retracted to permit the tool to be run through the wellbore on a drill string and once the tool has passed beyond the end of the casing, the blades are extended so the bore diameter may be increased below the casing.

The blades of some conventional expandable reamers have been sized to minimize a clearance between themselves and the tubular body in order to prevent any drilling mud and earth fragments from becoming lodged in the clearance and binding the blade against the tubular body. The blades of these conventional expandable reamers utilize pressure from inside the tool to apply force radially outward against pistons which move the blades, carrying cutting elements, laterally outward. It is felt by some that the nature of some conventional reamers allows misaligned forces to cock and jam the pistons and blades, preventing the springs from retracting the blades laterally inward. Also, designs of some conventional expandable reamer assemblies fail to help blade retraction when jammed and pulled upward against the wellbore casing. Furthermore, some conventional hydraulically actuated reamers utilize expensive seals disposed around a very complex shaped and expensive piston, or blade, carrying cutting elements. In order to prevent cocking, some conventional reamers are designed having the piston shaped oddly in order to try to avoid the supposed cocking, requiring matching and complex seal configurations. These seals are feared to possibly leak after extended usage.

Notwithstanding the various prior approaches to drill and/or ream a larger diameter wellbore below a smaller diameter wellbore, the need exists for improved apparatus and methods for doing so. For instance, bi-center and reamer wing assemblies are limited in the sense that the pass through diameter of such tools is nonadjustable and limited by the reaming diameter. Furthermore, conventional bi-center and eccentric bits may have the tendency to wobble and deviate from the path intended for the wellbore. Conventional expandable reaming assemblies, while sometimes more stable than bi-center and eccentric bits, may be subject to damage when passing through a smaller diameter wellbore or casing section, may be prematurely actuated, and may present difficulties in removal from the wellbore after actuation.

Additionally, if an operator of an expandable tool is not aware of the operating condition of the expandable tool (e.g., whether the tool is in an expanded or retracted position), damage to the tool, drill string and/or borehole may occur, and operating time and expenses may be wasted. In view of this, improved expandable apparatus and operating condition detection methods would be desirable.

BRIEF SUMMARY

In some embodiments, an expandable apparatus may comprise a tubular body, a valve piston and a push sleeve. The tubular body may comprise a fluid passageway extending therethrough, and the valve piston may be disposed within the tubular body, the valve piston configured to move axially downward within the tubular body responsive to a pressure of drilling fluid passing through the fluid passageway and configured to selectively control a flow of fluid into an annular chamber. The push sleeve may be disposed within the tubular body and coupled to at least one expandable feature, the push sleeve configured to move axially responsive to the flow of fluid into the annular chamber extending the at least one expandable feature.

In further embodiments, a method of operating an expandable apparatus may comprise positioning an expandable apparatus in a borehole, directing a fluid flow through a fluid passageway of a tubular body of the expandable apparatus, and moving a valve piston axially relative to the tubular body in response to fluid flow through the fluid passageway to open at least one fluid port to an annular chamber. The method may further comprise moving a push sleeve axially relative to the tubular body with a fluid flow directed into the annular chamber through the at least one fluid port, and extending at least one expandable feature coupled to the push sleeve.

DETAILED DESCRIPTION

The illustrations presented herein are, in some instances, not actual views of any particular expandable apparatus or component thereof, but are merely idealized representations that are employed to describe embodiments of the disclosure. Additionally, elements common between figures may retain the same numerical designation.

Various embodiments of the disclosure are directed to expandable apparatus. By way of example and not limitation, an expandable apparatus may comprise an expandable reamer apparatus, an expandable stabilizer apparatus or similar apparatus. As described in more detail herein, expandable apparatus of the present disclosure may be remotely selectable between at least two operating positions while located within a borehole. It may be important for an operator who is controlling or supervising the operation of the expandable apparatus to know the current operating position of the tool in the borehole, such as to prevent damage to the tool, the borehole, or other problems. In view of this, embodiments of the present disclosure include features that facilitate the remote detection of a change in operating position of the expandable apparatus (e.g., when the expandable apparatus changes from a retracted position to an expanded position).

Figure 1:
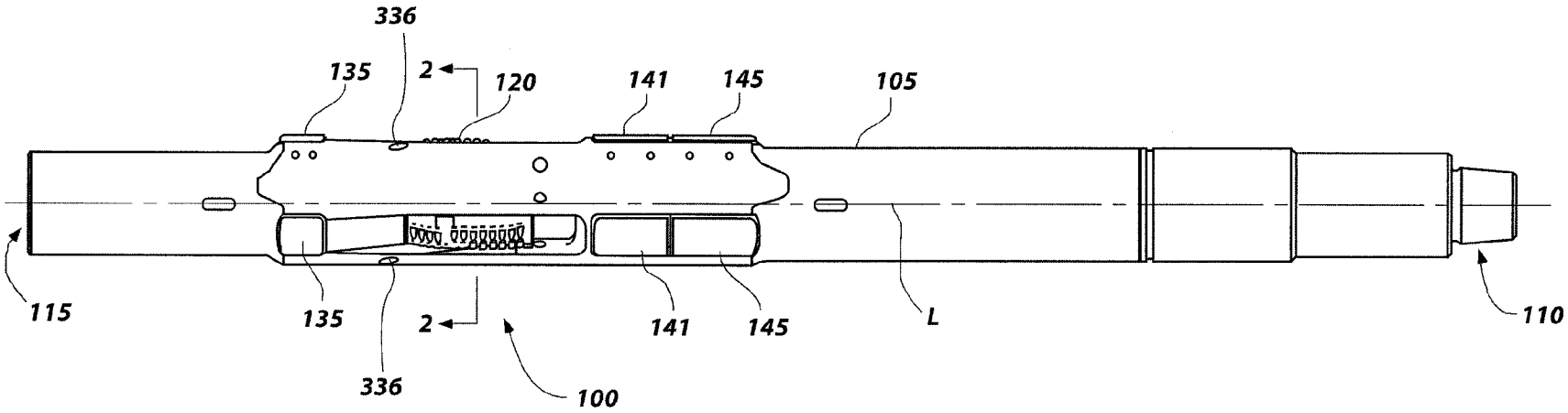
FIG. 1 is a side view of an embodiment of an expandable apparatus of the disclosure.

FIG. 1 illustrates an expandable apparatus 100 according to an embodiment of the disclosure comprising an expandable reamer. The expandable reamer may be similar to the expandable apparatus described in U.S. Patent Publication No. 2008/0128175, filed Dec. 3, 2007 and entitled "Expandable Reamers for Earth Boring Applications," the entire disclosure of which is incorporated herein by this reference.

The expandable apparatus 100 may include a generally cylindrical tubular body 105 having a longitudinal axis L. The tubular body 105 of the expandable apparatus 100 may have a lower end 110 and an upper end 115. The terms "lower" and "upper," as used herein with reference to the ends 110, 115, refer to the typical positions of the ends 110, 115 relative to one another when the expandable apparatus 100 is positioned within a wellbore. The lower end 110 of the tubular body 105 of the expandable apparatus 100 may include a set of threads (e.g., a threaded male pin member) for connecting the lower end 110 to another section of a drill string or another component of a bottom-hole assembly (BHA), such as, for example, a drill collar or collars carrying a pilot drill bit for drilling a wellbore. Similarly, the upper end 115 of the tubular body 105 of the expandable apparatus 100 may include a set of threads (e.g., a threaded female box member) for connecting the upper end 115 to another section of a drill string or another component of a bottom-hole assembly (BHA) (e.g., an upper sub).

At least one expandable feature may be positioned along the expandable apparatus 100. For example, three expandable features configured as sliding cutter blocks or blades 120, 125, 130 (see FIG. 2) may be positionally retained in circumferentially spaced relationship in the tubular body 105 as further described below and may be provided at a position along the expandable apparatus 100 intermediate the lower end 110 and the upper end 115. The blades 120, 125, 130 may be comprised of steel, tungsten carbide, a particle-matrix composite material (e.g., hard particles dispersed throughout a metal matrix material), or other suitable materials as known in the art. The blades 120, 125, 130 are retained in an initial, retracted position within the tubular body 105 of the expandable apparatus 100 as illustrated in FIG. 3, but may be moved responsive to application of hydraulic pressure into the extended position (shown in FIG. 4) and moved into a retracted position (shown in FIG. 5) when desired, as will be described herein. The expandable apparatus 100 may be configured such that the blades 120, 125, 130 engage the walls of a subterranean formation surrounding a wellbore in which the expandable apparatus 100 is disposed to remove formation material when the blades 120, 125, 130 are in the extended position, but are not operable to so engage the walls of a subterranean formation within a wellbore when the blades 120, 125, 130 are in the retracted position. While the expandable apparatus 100 includes three blades 120, 125, 130, it is contemplated that one, two or more than three blades may be utilized to advantage. Moreover, while the blades 120, 125, 130 are symmetrically circumferentially positioned axially along the tubular body 105, the blades may also be positioned circumferentially asymmetrically as well as asymmetrically along the longitudinal axis L in the direction of either end 110 or 115.

The expandable apparatus 100 may optionally include a plurality of stabilizer blocks 135, 141, 145. In some embodiments, a mid stabilizer block 141 and a lower stabilizer block 145 may be combined into a unitary stabilizer block. The stabilizer blocks 135, 141, 145 may facilitate the centering of the expandable apparatus 100 within the borehole while being run into position through a casing or liner string and also while drilling and reaming the wellbore. In other embodiments, no stabilizer blocks may be employed. In such embodiments, the tubular body 105 may comprise a larger outer diameter in the longitudinal portion where the stabilizer blocks are shown in FIG. 1 to provide a similar centering function as provided by the stabilizer blocks.

An upper stabilizer block 135 may be used to stop or limit the forward motion of the blades 120, 125, 130 (see also FIG. 3), determining the extent to which the blades 120, 125, 130 may engage a bore hole while drilling. The upper stabilizer block 135, in addition to providing a back stop for limiting the lateral extent of the blades when extended, may provide for additional stability when the blades 120, 125, 130 are retracted and the expandable apparatus 100 of a drill string is positioned within a bore hole in an area where an expanded hole is not desired while the drill string is rotating. Advantageously, the upper stabilizer block 135 may be mounted, removed and/or replaced by a technician, particularly in the field, allowing the extent to which the blades 120, 125, 130 engage the bore hole to be readily increased or decreased to a different extent than illustrated. Optionally, it is recognized that a stop associated on a track side of the upper stabilizer block 135 may be customized in order to arrest the extent to which the blades 120, 125, 130 may laterally extend when fully positioned to the extended position along the blade tracks 220. The stabilizer blocks 135, 140, 145 may include hardfaced bearing pads (not shown) to provide a surface for contacting a wall of a bore hole while stabilizing the expandable apparatus 100 therein during a drilling operation.

Figure 2:
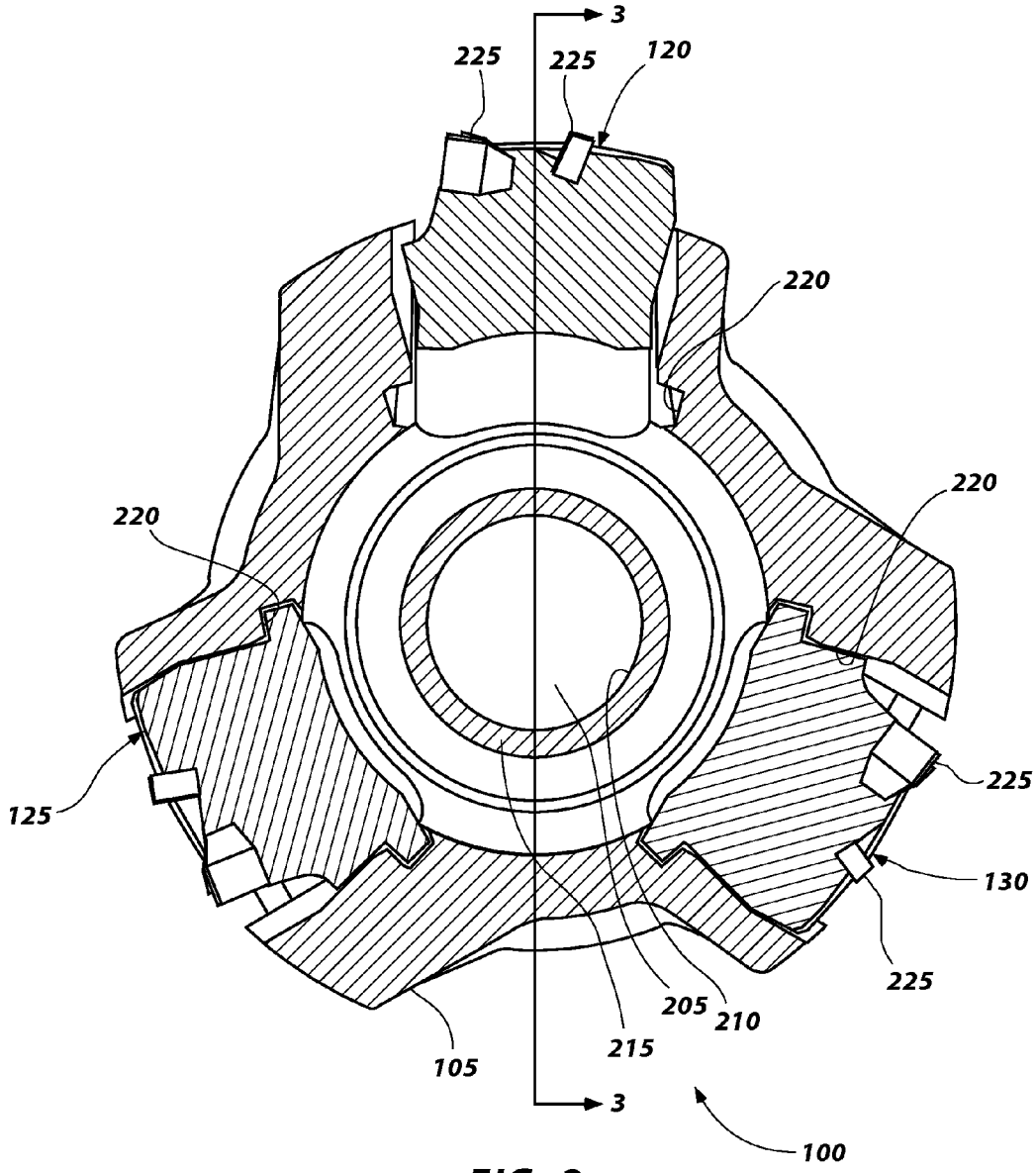
FIG. 2 shows a transverse cross-sectional view of the expandable apparatus as indicated by section line 2-2 in FIG. 1.
Figure 3:
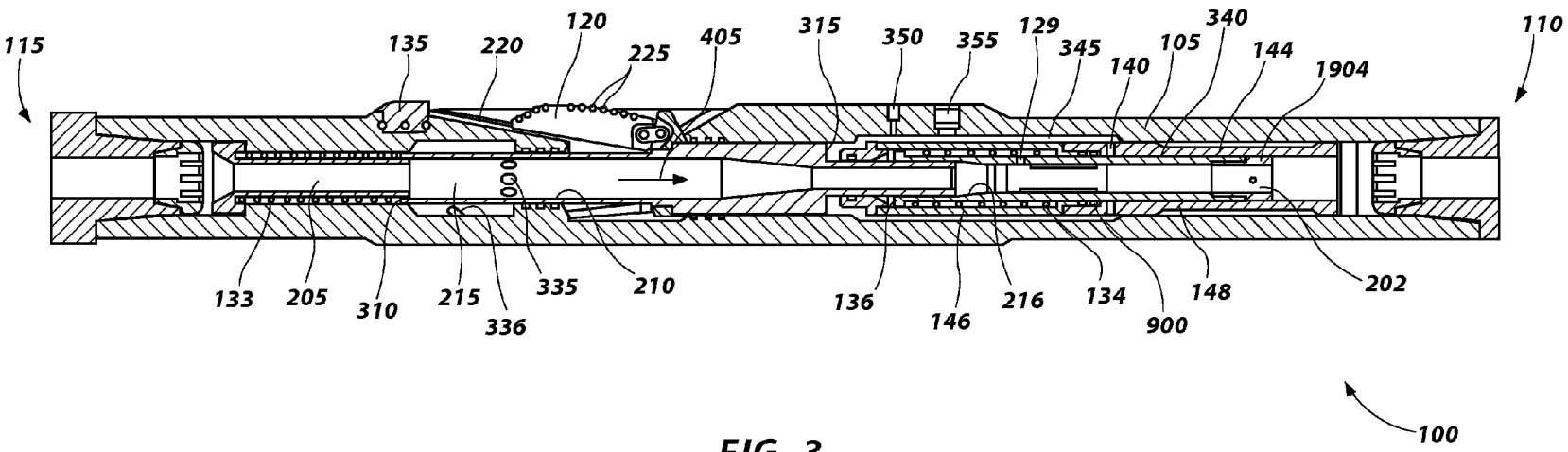
FIG. 3 shows a longitudinal cross-sectional view of the expandable apparatus shown in FIG. 1 in a neutral position.

FIG. 2 is a cross-sectional view of the expandable apparatus 100 shown in FIG. 1 taken along section line 2-2 shown therein. As shown in FIG. 2, the tubular body 105 encloses a fluid passageway 205 that extends longitudinally through the tubular body 105. The fluid passageway 205 directs fluid substantially through an inner bore 210 of a push sleeve 215. To better describe aspects of this embodiment, blades 125 and 130 are shown in FIG. 2 in the initial or retracted positions, while blade 120 is shown in the outward or extended position. The expandable apparatus 100 may be configured such that the outermost radial or lateral extent of each of the blades 120, 125, 130 is recessed within the tubular body 105 when in the initial or retracted positions so it may not extend beyond the greatest extent of outer diameter of the tubular body 105. Such an arrangement may protect the blades 120, 125, 130, a casing, or both, as the expandable apparatus 100 is disposed within the casing of a wellbore, and may allow the expandable apparatus 100 to pass through such casing within a wellbore. In other embodiments, the outermost radial extent of the blades 120, 125, 130 may coincide with or slightly extend beyond the outer diameter of the tubular body 105. As illustrated by blade 120, the blades 120, 125, 130 may extend beyond the outer diameter of the tubular body 105 when in the extended position, to engage the walls of a wellbore in a reaming operation.

FIG. 3 is another cross-sectional view of the expandable apparatus 100 shown in FIGS. 1 and 2 taken along section line 3-3 shown in FIG. 2. Referring to FIGS. 2 and 3, the tubular body 105 positionally retains three sliding cutter blocks or blades 120, 125, 130 in three respective blade tracks 220. The blades 120, 125, 130 each carry a plurality of cutting elements 225 for engaging the material of a subterranean formation defining the wall of an open wellbore when the blades 120, 125, 130 are in an extended position. The cutting elements 225 may be polycrystalline diamond compact (PDC) cutters or other cutting elements known to a person of ordinary skill in the art and as generally described in U.S. Pat. No. 7,036,611, the disclosure of which is incorporated herein in its entirety by this reference.

Referring to FIG. 3, the blades 120, 125, 130 (as illustrated by blade 120) may be hingedly coupled to the push sleeve 215. The push sleeve 215 may be configured to slide axially within the tubular body 105 in response to pressures applied to one end or the other, or both. In some embodiments, the push sleeve 215 may be disposed in the tubular body 105 and may be configured similar to the push sleeve described by U.S. Patent Publication No. 2008/0128175 referenced above and biased by a spring as described therein. However, as illustrated in FIG. 3, the expandable apparatus 100 described herein does not require the use of a central stationary sleeve and, rather, the inner bore 210 of the push sleeve 215 may form the fluid passageway.

As shown in FIG. 3, the push sleeve 215 may comprise an upper surface 310 and a lower surface 315 at opposing longitudinal ends. Such a push sleeve 215 may be configured and positioned so that the upper surface 310 comprises a smaller annular surface area than the lower surface 315 to create a greater force on the lower surface 315 than on the upper surface 310 when a like pressure is exerted on both surfaces by a pressurized fluid, as described in more detail below. Before drilling, the push sleeve 215 may be biased toward the bottom end 110 of the expandable apparatus 100 by a first spring 133. The first spring 133 may resist motion of the push sleeve 215 toward the upper end 115 of the expandable apparatus 100, thus biasing the blades 120, 125, 130 to the retracted position. This facilitates the insertion and/or removal of the expandable apparatus 100 from a wellbore without the blades 120, 125, 130 engaging walls of a subterranean formation or casing defining the wellbore.

The push sleeve 215 may further include a plurality of nozzle ports 335 that may communicate with a plurality of nozzles 336 for directing a drilling fluid toward the blades 120, 125, 130.

Figure 4:
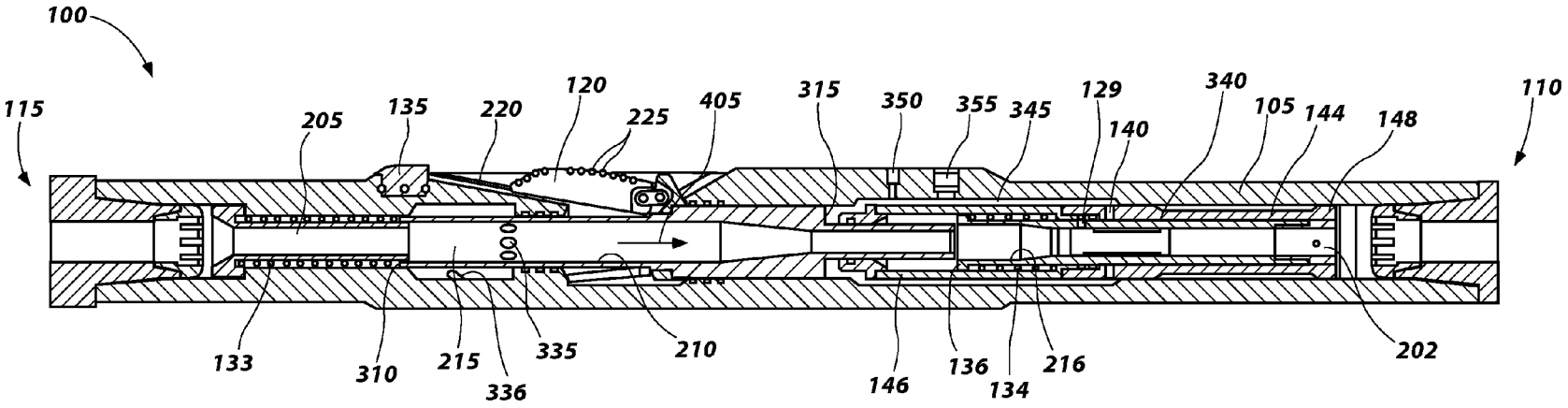
FIG. 4 shows a longitudinal cross-sectional view of the expandable apparatus shown in FIG. 1 in a locked closed position.
Figure 5:
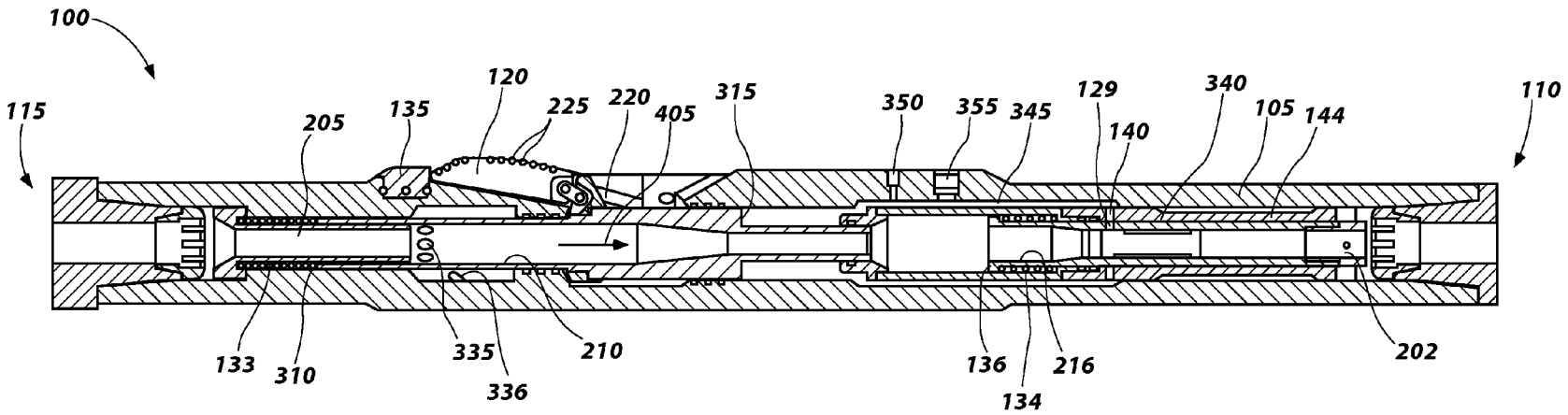
FIG. 5 shows a longitudinal cross-sectional view of the expandable apparatus shown in FIG. 1 in a locked opened position.

As shown in FIGS. 3-5, the plurality of nozzle ports 335 may be configured such that they are always in communication with the plurality of nozzles 336. In other words, the plurality of nozzle ports 335 and corresponding nozzles 336 may be in a continuously open position regardless of a position of the blades 120, 125, 130. Having the nozzle ports 335 and the corresponding nozzles 336 in a continuously open position may help to prevent any blockages from forming in the nozzle ports 335 and the corresponding nozzles 336. Furthermore, having the nozzle ports 335 and the corresponding nozzles 336 in a continuously open position may help keep the blades 120, 125, 130 and an exterior of the expandable apparatus 100 cool while in a wellbore at all times. However, in some embodiments, the nozzle ports 335 may be temporarily closed, such as to produce a detectable pressure change of the drilling fluid, as will be described in further detail herein with reference to FIG. 8.

Figure 9A:
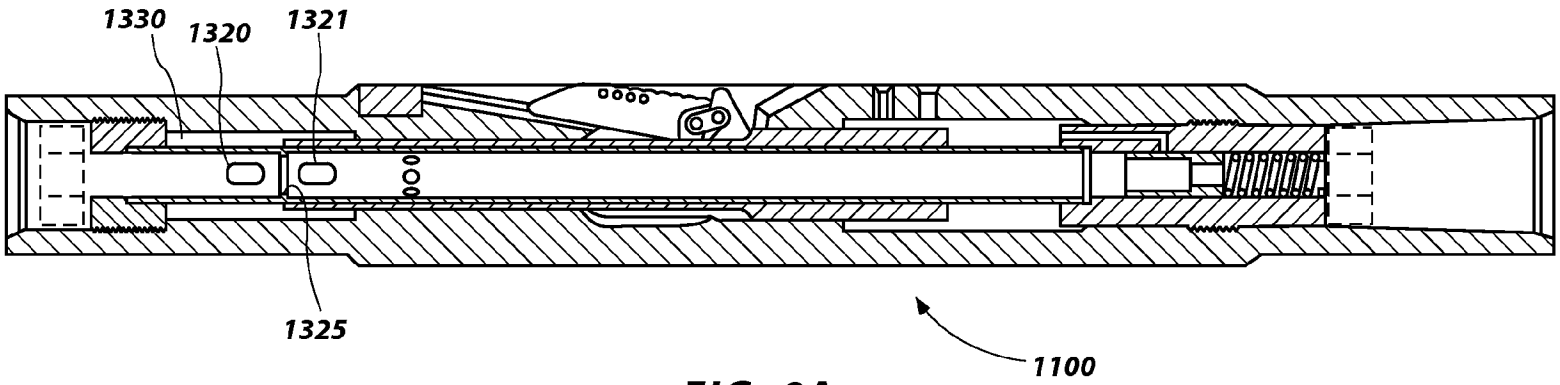
FIG. 9A shows a longitudinal cross-sectional view of an expandable apparatus including fluid ports on either side of a necked down orifice.
Figure 9B:
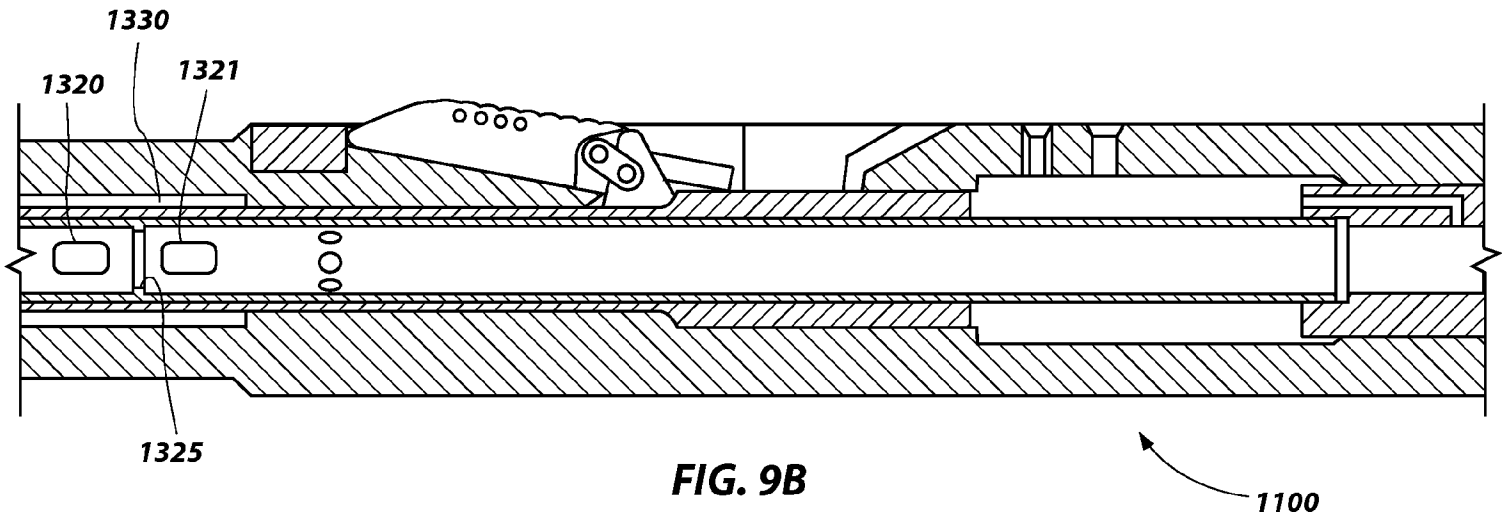
FIG. 9B shows an enlarged cross-sectional view of the expandable apparatus shown in FIG. 9A and with the blades expanded.

Referring again to FIG. 3, a valve piston 216 may also be disposed within the expandable apparatus 100 and configured to move axially within the expandable apparatus 100 in response to fluid pressures applied to the valve piston 216. Before expansion of the expandable apparatus 100, the valve piston 216 may be biased toward the upper end 115 of the expandable apparatus 100, such as by a spring 134. The expandable apparatus 100 may also include a stationary valve housing 144 (e.g., stationary relative to the tubular body 105) axially surrounding the valve piston 216. The valve housing 144 may include an upper portion 146 and a lower portion 148. The lower portion 148 of the valve housing 144 may include at least one fluid port 140 which is configured to selectively align with at least one fluid port 129 formed in the valve piston 216. When the at least one fluid port 129 of the valve piston 216 is aligned with the at least one fluid port 140 of the lower portion 148 of the valve housing 144, fluid may flow from the fluid passageway 205 to a lower annular chamber 345 between the inner sidewall of the tubular body 105 and the outer surfaces of the valve housing 144, and in communication with the lower surface 315 of the push sleeve 215. In further embodiments, the valve piston 216 may not include a fluid port 129, but may otherwise move longitudinally relative to the valve housing 144 and leave the at least one fluid port 140 unobstructed to allow fluid flow therethrough, such as shown in FIGS. 9A and 9B.

In operation, the push sleeve 215 may be originally positioned toward the lower end 110 with the at least one fluid port 129 of the valve piston 216 misaligned with the at least one fluid port 140 of the lower portion 148 of the valve housing 144. This original position may also be referred to as a neutral position and is illustrated in FIG. 3. In the neutral position, the blades 120, 125, 130 are in the retracted position and are maintained that way by the first spring 133 biasing the push sleeve 215 towards the bottom end 110 of the expandable apparatus 100 without the flow of any fluid. A fluid, such as a drilling fluid, may be flowed through the fluid passageway 205 in the direction of arrow 405. As the fluid flows through the fluid passageway 205, the fluid exerts a force on a surface 136 of the valve piston 216 in addition to the fluid being forced through a reduced area formed by a nozzle 202 coupled to the valve piston 216. When the pressure on the surface 136 and the nozzle 202 becomes great enough to overcome the biasing force of the second spring 134, the valve piston 216 moves axially toward the bottom end 110 of expandable apparatus 100 as shown in FIG. 4. As shown in FIG. 4, although the valve piston has moved axially toward the bottom end 100 of the expandable apparatus 100, the at least one fluid port 129 of the valve piston 216 remains misaligned with the at least one fluid port 140 of the lower portion 148 of the valve housing 144. This position, as illustrated in FIG. 4, may be referred to as the locked closed position. In the locked closed position, the blades will remain in the fully retracted position while fluid is flowed through the fluid passageway 205 as the position of the valve piston 216 may be mechanically held, such as by a pin and pin track mechanism further described herein with reference to FIGS. 12A-12C.

When the at least one fluid port 129 of the valve piston 216 and the at least one fluid port 140 of the lower portion 148 of the valve housing 144 are selectively aligned, as will be described in greater detail below, the fluid flows from the fluid passageway 205 into the annular chamber 345, causing the fluid to pressurize the annular chamber 345 and exert a force on the lower surface 315 of the push sleeve 215. As described above, the lower surface 315 of the push sleeve 215 has a larger surface area than the upper surface 310. Therefore, with equal or substantially equal pressures applied to the upper surface 310 and lower surface 315 by the fluid, the force applied on the lower surface 315, having the larger surface area, will be greater than the force applied on the upper surface 310, having the smaller surface area, by virtue of the fact that force is equal to the pressure applied multiplied by the area to which it is applied. When the pressure on the lower surface 315 is great enough to overcome the force applied by the first spring 133, the resultant net force is upward and causes the push sleeve 215 to slide upward, thereby extending the blades 120, 125, 130, as shown in FIG. 5, which is also referred to as the locked open position.

In some embodiments, a resettable check valve may be included, such as located within the at least one fluid port 140, that may prevent fluid from flowing through the at least one fluid port 140 until a predetermined pressure is achieved. After the at least one fluid port 129 of the valve piston 216 and the at least one fluid port 140 of the lower portion 148 of the valve housing 144 are selectively aligned, activation may be delayed until a predetermined fluid pressure is achieved. In view of this, a predetermined fluid pressure may be achieved prior to movement of the blades 120, 125, 130 to an expanded position. A specific pressure, or a change in pressure, may then be detected, such as by a pressure sensor as described further herein, to signal to an operator that the blades 120, 125, 130 have moved to the expanded position. By including the check valve, the peak pressure achieved and the change in pressure upon activation may be increased and the measurement of the peak pressure or the change in pressure may be more readily ascertained and may be more reliable in indicating that the blades 120, 125, 130 have moved to an extended position.

Figure 6A:
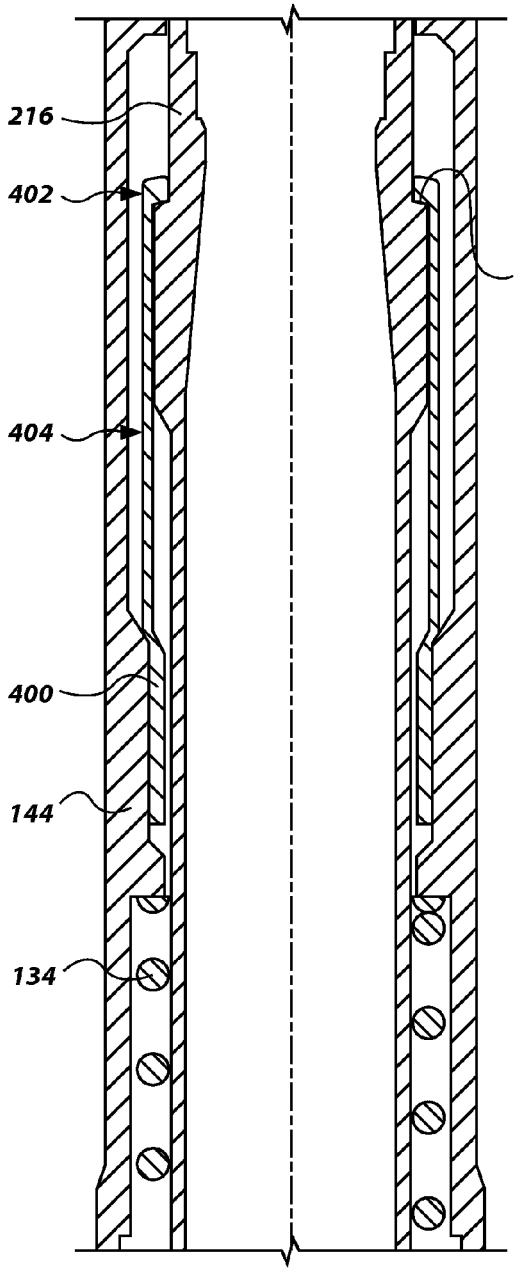
FIGS. 6A and 6B show a longitudinal cross-sectional detail view of a valve piston and valve housing including a collet.
Figure 6B:
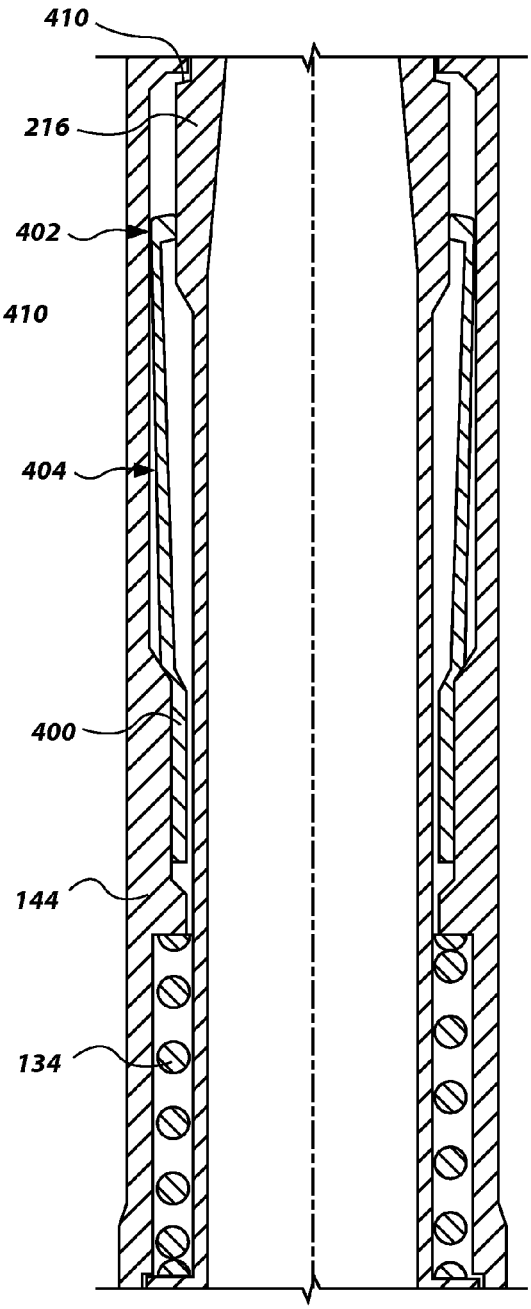

In further embodiments, a collet 400 may be utilized to maintain the valve piston 216 in a selected axial position until a predetermined axial force is applied (e.g., when a predetermined fluid pressure or fluid flow is achieved), as shown in FIGS. 6A and 6B, which may facilitate at least one of a peak pressure and a change in pressure that may be reliably identified via a pressure sensor and utilized to alert an operator that the blades 120, 125, 130 have moved to an extended position. The collet 400 may comprise a plurality of end segments 402 coupled to biasing members 404 that may bias the end segments 402 radially inward. The valve piston 216 may include a shoulder 410 and the end segments 402 of the biased collet 400 may be positioned over the shoulder 410, when the expandable apparatus 100 is in a neutral position, as shown in FIG. 6A. Upon applying a predetermined axial force to the valve piston 216 (e.g., when a predetermined fluid pressure or fluid flow is achieved), the shoulder 410 may push against the end segments 402 of the collet 400 and overcome the force applied by the biasing members 404 of the collet 400 and push the end segments 402 radially outward, as shown in FIG. 6B. In view of this, the valve piston 216 may not move out of the closed position until an axial force applied to the valve piston 216 exceeds a threshold amount. By maintaining the position of the valve piston 216 until a predetermined amount of force is applied, a fluid flow and pressure required to move the shoulder 410 of valve piston 216 past the end segments 402 of the collet 400 may be greater than is required to move the valve piston 216 after the end segments 402 have been pushed radially outward past the shoulder 410. In view of this, at least one of a predetermined fluid flow and pressure may be achieved prior to movement of the blades 120, 125, 130 (FIG. 2) to an expanded position. A specific pressure, or a change in pressure, may then be detected and utilized to signal to an operator that the blades 120, 125, 130 have moved to an expanded position.

Additionally, a collet 400 may also be utilized to maintain the valve piston 216 in an axial position corresponding to the fully expanded position of the blades 120, 125, 130. In view of this, at least one collet 400 may be positioned relative to at least one shoulder 410 to resist movement of the valve piston 216 from one or more of a first axial position corresponding to a fully retracted position of the blades 120, 125, 130 (e.g., a relatively low drilling fluid pressure state), and a second axial position corresponding to a fully expanded position of the blades 120, 125, 130 (e.g., a relatively high drilling fluid pressure state).

Figure 7A:
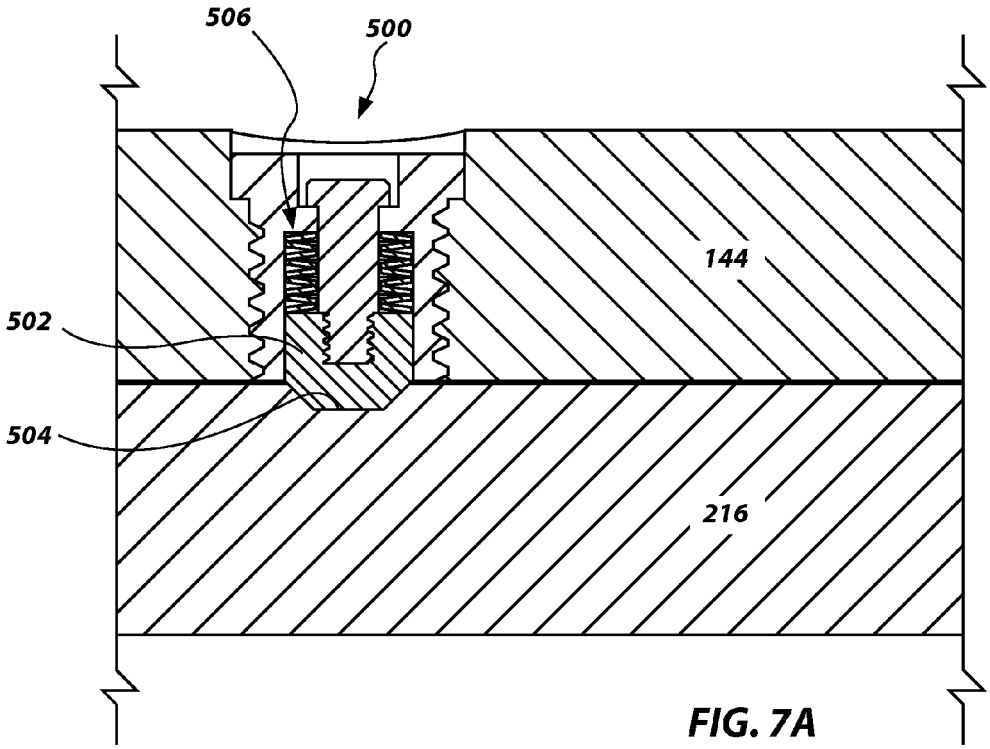
FIGS. 7A and 7B show a longitudinal cross-sectional detail view of a valve piston and valve housing including a detent.
Figure 7B:
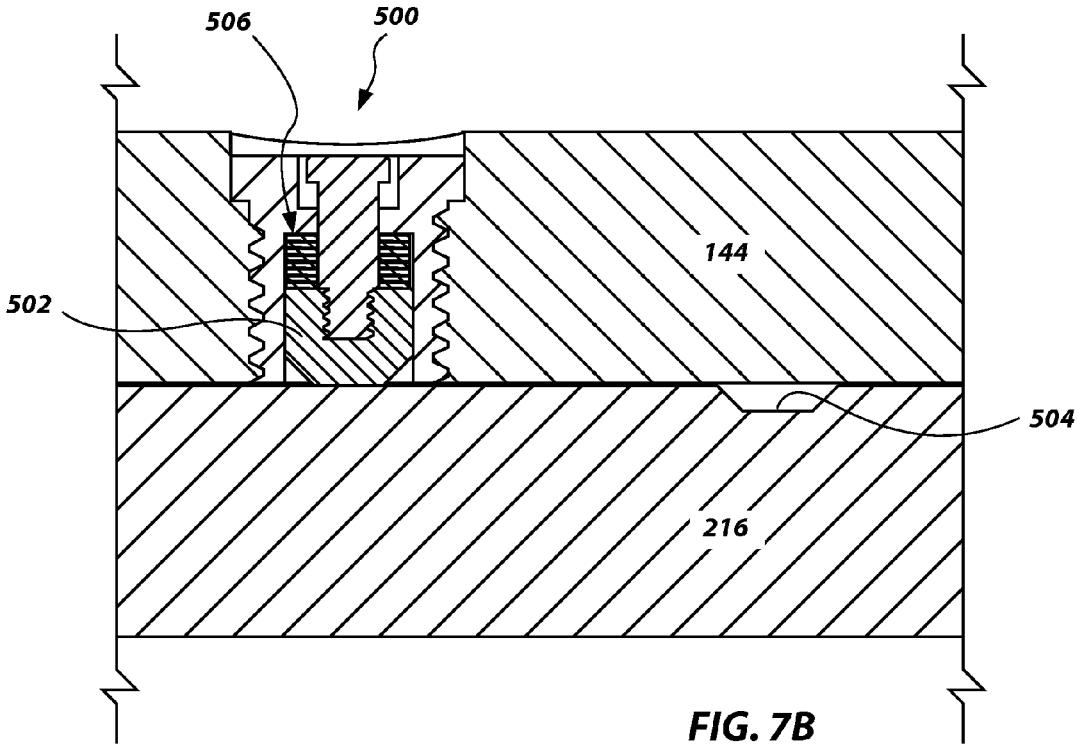

In further embodiments, a detent 500 may be utilized to maintain the valve piston 216 in a selected axial position until a predetermined axial force is applied (e.g., when a predetermined pressure is achieved), as shown in FIGS. 7A and 7B. The detent 500 may comprise a movable protrusion 502 biased toward the valve piston 216, by a biasing member 506, such as by a spring (e.g., a helical compression spring or a stack of Belleville washers). The valve piston 216 may include a cavity, such as a groove 504 that may extend circumferentially around the valve piston 216, and the movable protrusion 502 may be positioned at least partially within the cavity (e.g., groove 504) when the device is in a neutral position, as shown if FIG. 7A. Upon applying a predetermined axial force to the valve piston 216, the groove 504 may push against the moveable protrusion 502 of the detent 500 and overcome the force applied by the biasing members 506 of the detent 500 and push the movable protrusion 502 out of the groove 504, as shown in FIG. 7B. In view of this, the valve piston 216 may not move out of the neutral position until an axial force applied to the valve piston 216 exceeds a threshold amount. By maintaining the position of the valve piston 216 until a predetermined amount of force is applied, a fluid flow and pressure required to move the groove 504 of the valve piston 216 past the movable protrusion 502 of the detent 500 may be greater than is required to move the valve piston 216 after the movable protrusion 502 has been pushed past the groove 504. In view of this, a predetermined fluid pressure may be achieved prior to movement of the blades 120, 125, 130 (FIG. 2) to an expanded position. In view of this, at least one of a predetermined fluid flow and pressure may be achieved prior to movement of the blades 120, 125, 130 (FIG. 2) to an expanded position. A specific pressure, or a change in pressure, may then be detected and utilized to signal to an operator that the blades 120, 125, 130 have moved to an expanded position.

Additionally, a detent 500 may also be utilized to maintain the valve piston 216 in an axial position corresponding to the fully expanded position of the blades 120, 125, 130. In view of this, at least one detent 500 may be positioned relative to at least one groove 504 to resist movement of the valve piston 216 from one or more of a first axial position corresponding to a fully retracted position of the blades 120, 125, 130 (e.g., a relatively low drilling fluid pressure state), and a second axial position corresponding to a fully expanded position of the blades 120, 125, 130 (e.g., a relatively high drilling fluid pressure state).

Figure 8A:
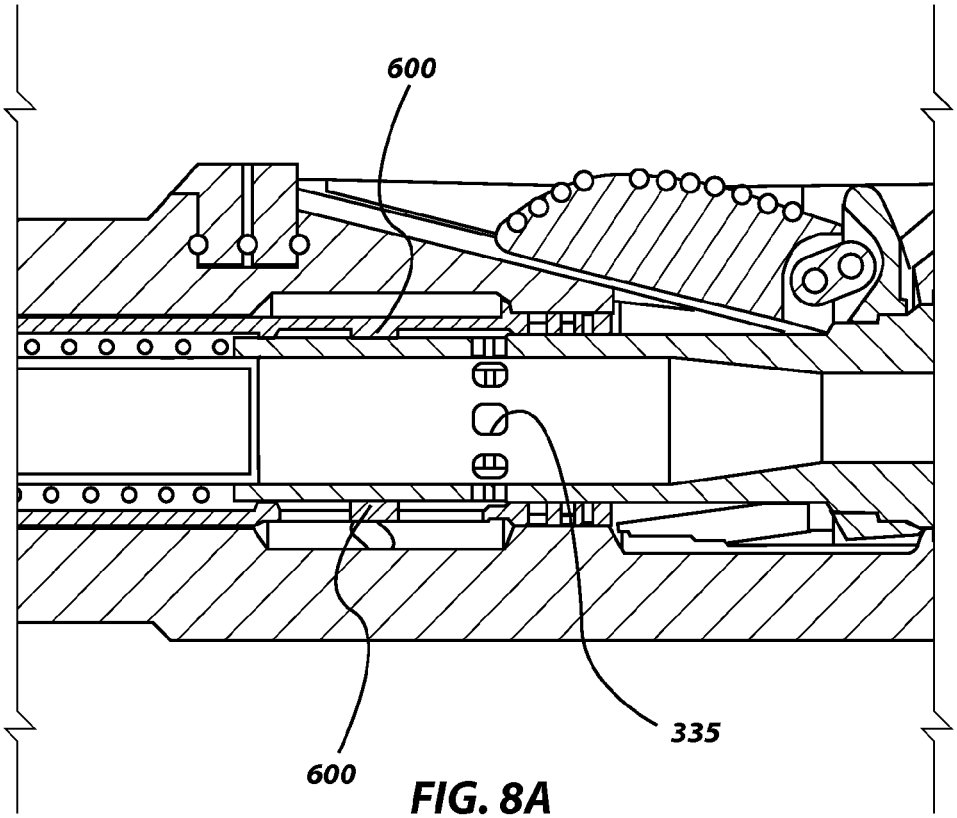
FIGS. 8A and 8B show a longitudinal cross-sectional detail view of a portion of an expandable apparatus including a sealing member to temporarily close nozzle ports of a push sleeve.
Figure 8B:
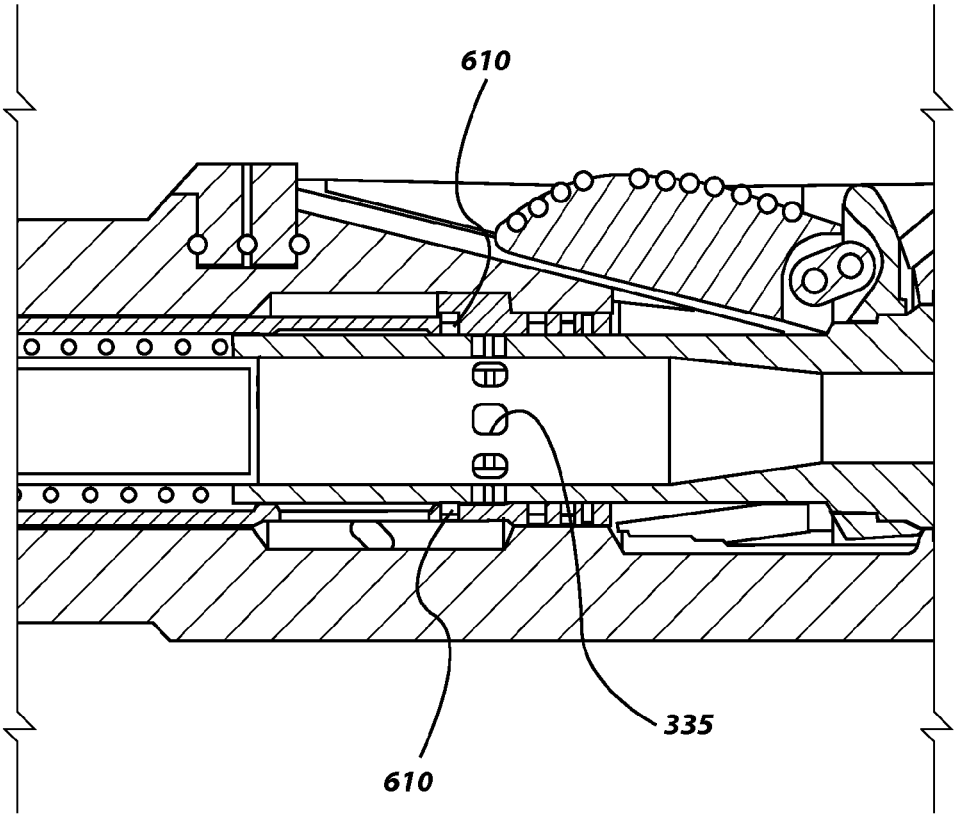

In further embodiments, the plurality of nozzle ports 335 may be configured such that they are in communication with the plurality of nozzles except for when the blades are positioned in a less than fully expanded position, which may facilitate at least one of a peak pressure and a change in pressure that may be reliably identified via a pressure sensor and utilized to alert an operator that the blades 120, 125, 130 have moved to an extended position. For example, the plurality of nozzle ports 335 and corresponding nozzles may be closed to fluid communication just before the blades 120, 125, 130 are in the fully expanded position, such as by passing a sealing member 600 as shown in FIG. 8A. This temporary closing of the nozzle ports as the tool transitions between the retracted position and the fully expanded position may provide a significant and reliably detectable pressure change, which may be detected to signal to an operator that the blades have moved to the fully expanded position. For another example, the plurality of nozzle ports 335 and corresponding nozzles may be closed to fluid communication when the blades 120, 125, 130 are in the fully retracted position by a sealing member 610 and open to fluid communication when the blades are in the fully expanded position, as shown in FIG. 8B.

In yet further embodiments, an expandable apparatus 1100 may include fluid ports 1320 and 1321 on either side of a necked down orifice 1325, as shown in FIGS. 9A and 9B. When one of the fluid ports 1320, 1321 is closed, as shown in FIG. 9A, any fluid passing through the tubular body will be directed through the necked down orifice 1325. With both the fluid ports 1320 and 1321 open to an upper annular chamber 1330, as shown in FIG. 9B, the fluid exits the upper fluid port 1320 above the necked down orifice 1325, into the upper annular chamber 1330 and then back into the fluid passageway 205 (see FIG. 2) through the lower fluid port 1321 below the necked down orifice 1325. This increases the total flow area through which the drilling fluid may flow (e.g., through the necked down orifice 1325 and through the upper annular chamber 1330 by way of the fluid ports 1320 and 1321. The increase in the total flow area results in a substantial reduction in fluid pressure above the necked down orifice 1325.

This change in pressure resulting from the activation of the expandable apparatus 1100 may be utilized to facilitate the detection of the operating condition of the expandable apparatus 1100. The change in pressure may be detected by a fluid pressure monitoring device, which may alert the operator as to the change in operating conditions of the expandable apparatus 1100. The change in pressure may be identified in data comprising the monitored standpipe pressure, and may indicate to the operator that the blades 120, 125, 130 (see FIG. 2) of the expandable apparatus 1100 are in the expanded position. In other words, the change in pressure may provide a signal to the operator that the blades 120, 125, 130 (see FIG. 2) have been expanded for engaging the borehole.

In at least some embodiments, the change in pressure may be a pressure drop of between about 140 psi and about 270 psi facilitated by the opening of the fluid ports 1320 and 1321. In one non-limiting example, the push sleeve 215 (see FIG. 2) may comprise an inner bore 210 (see FIG. 2) having a diameter of about 2.25 inches (about 57.2 mm) and the fluid ports 1320 and 1321 may be about 2 inches (50.8 mm) long and about 1 inch (25.4 mm) wide. In such an embodiment, a necked down orifice 1325 comprising an inner diameter of about 1.625 inches (about 41.275 mm) may result in a drop in the monitored standpipe pressure of about 140 psi (about 965 kPa), assuming there are no nozzles, (the nozzles being optional according to various embodiments). In another example of such an embodiment, a necked down orifice 1325 comprising an inner diameter of about 1.4 inches (about 35.56 mm) may result in a drop in the monitored standpipe pressure of about 269 psi (about 1.855 MPa).

Figure 10:
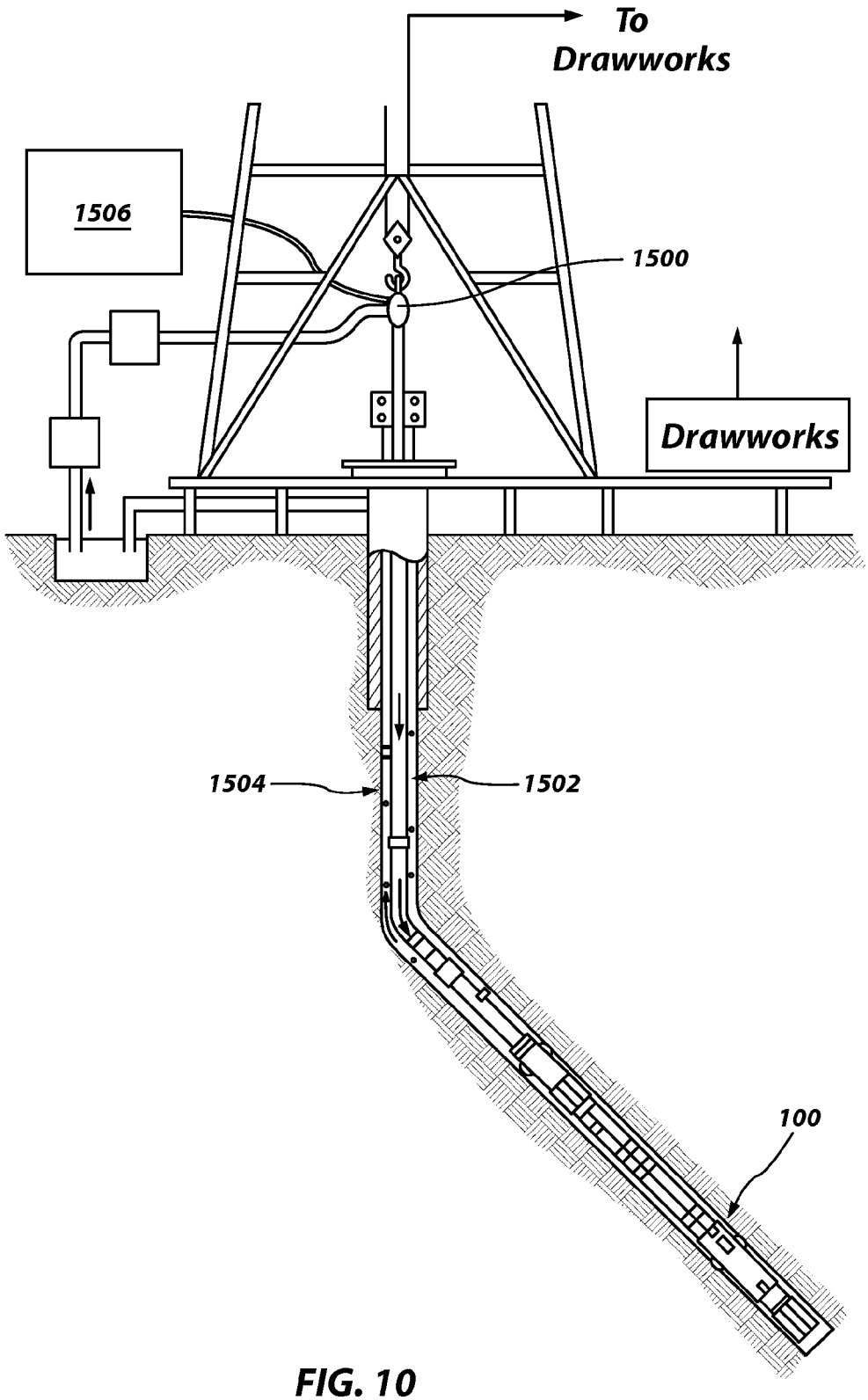
FIG. 10 is an elevation view of a drilling system including an expandable apparatus, according to an embodiment of the disclosure.

In additional embodiments, an acoustic sensor 1500 may be coupled to a drill string 1502, such as at a location outside of a borehole 1504, and in communication with a computer 1506, as shown in FIG. 10. The acoustic sensor 1500 may detect pressure waves (i.e., sound waves) that may be transmitted through the drill string 1502. When the expandable apparatus 100 is activated, and the blades 120, 125, 130 are moved to the expanded position, components of the expandable apparatus may impact other components of the expandable apparatus 100, such as shown in FIG. 5. For example, the blades 120, 125, 130 may impact stabilizer blocks 135. Such an impact may cause pressure waves to travel through the drill string 1502 which may be detected by the acoustic sensor 1500. The acoustic sensor 1500 may then transmit a signal to the computer 1506 corresponding to the detected pressure wave and the operator may be signaled that the blades 120, 125, 130 have moved to an expanded position.

Additionally, a pressure sensor, such as a pressure transducer, may be included within the drill string 1502, or elsewhere in the flow line of the drilling fluid, and may be in communication with the computer 1506. Pressure measurements may then be taken over a period of time and transmitted to the computer. The pressure measurements may then be compared, such as by plotting as a function of time, by the computer and the measured change in pressure over time may be utilized to determine the operating condition of the expandable apparatus 100, such as if the blades 120, 125, 130 have moved to an expanded position. By utilizing a comparison over time, even if a measured peak pressure that corresponds to a change in the operating condition of the expandable apparatus is relatively small compared to a baseline measurement, the comparison of pressures over time may provide an indication of a pressure change and be utilized to alert an operator of a change in the operating condition of the tool.

In view of this, one or both of a pressure sensor and an acoustic sensor 1500 may be coupled to the computer 1506 and the movement of the blades 120, 125, 130 to one of the expanded position and the retracted position may be reliably detected and communicated to an operator.

Figure 11A:
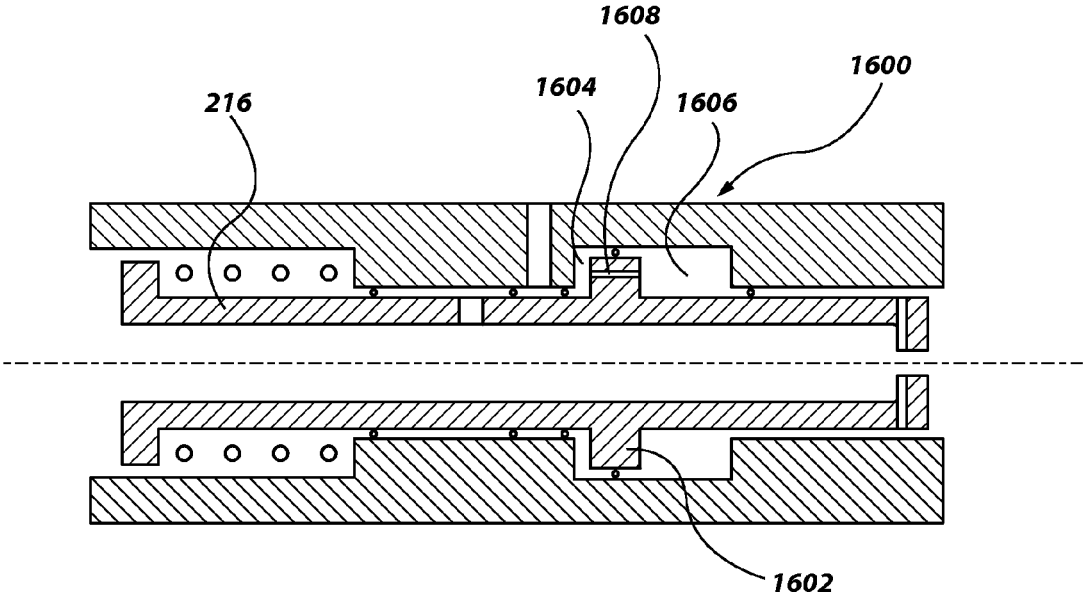
FIGS. 11A and 11B show cross-sectional details views of a valve piston and valve housing including a dashpot.
Figure 11B:
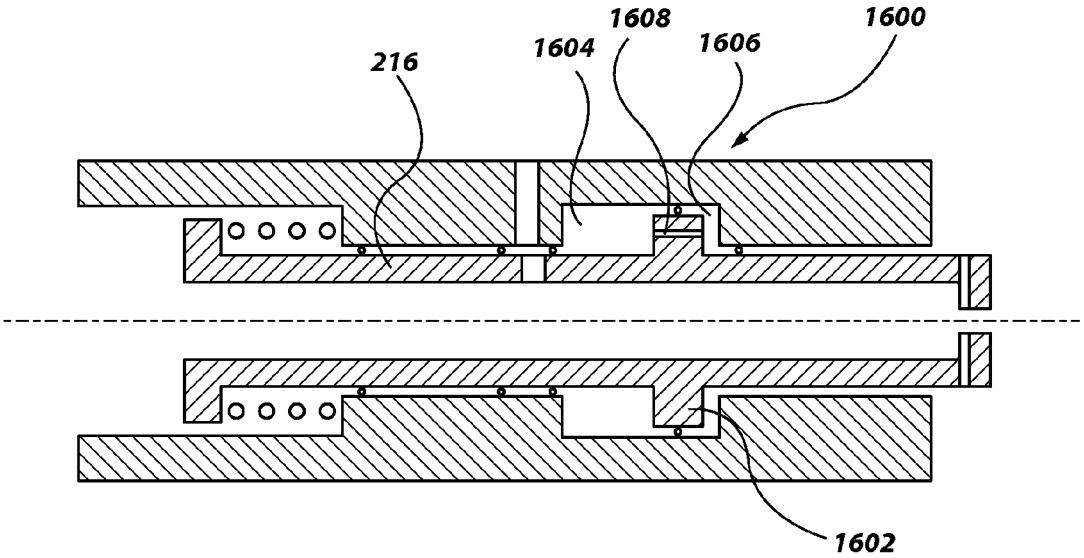

In yet further embodiments, a dashpot 1600 may be utilized to slow the axial displacement of a valve piston 216 in at least one direction, as shown in FIGS. 11A and 11B. The dashpot 1600 may comprise a fluid filled cavity, such as an annular cavity including a portion 1602 of the valve piston 216 therein defining a first fluid reservoir 1604 and a second fluid reservoir 1606. The portion 1602 of the valve piston 216 may include one or more apertures 1608 formed therein to allow the fluid to flow between the first fluid reservoir 1604 and the second fluid reservoir 1606. The apertures 1608 may be selectively sized, and fluid properties (e.g., viscosity) of the fluid contained in the first and second fluid reservoirs 1604 and 1606, may be selected to control a flow rate between the first fluid reservoir 1604 and the second fluid reservoir 1606, and thus control the actuation speed. By slowing the axial movement of the valve piston 216 with the dashpot 1600, the actuation may be delayed, and an increased fluid pressure in the standpipe may be achieved. Additionally, the duration of a change in fluid pressure may be increased. At least one of a specific pressure and a change in pressure may then be detected and utilized to signal to an operator that the blades 120, 125, 130 of the expandable apparatus 100 have moved to one of an expanded position and a retracted position.

In order to retract the blades 120, 125, 130, referring again to FIGS. 3-5, the at least one fluid port 129 of the valve piston 216 and the at least one fluid port 140 of the lower portion 148 of the valve housing 144 may be selectively misaligned to inhibit the fluid from flowing into the annular chamber 345 and applying a pressure on the lower surface 315 of the push sleeve 215. When the at least one fluid port 129 of the valve piston 216 and the at least one fluid port 140 of the lower portion 148 of the valve housing 144 are selectively misaligned, a volume of drilling fluid may remain trapped in the lower chamber 345. At least one pressure relief nozzle 350 may accordingly be provided, extending through the sidewall of the tubular body 105 to allow the drilling fluid to escape from the annular chamber 345 and into an area between the wellbore wall and the expandable apparatus 100. The at least one pressure relief nozzle 350 may be always open or open upon application of a pressure differential, such as a check valve, and, thus, may also be referred to as a pressure release nozzle or a bleed nozzle. The one or more pressure relief nozzles 350 may comprise a relatively small flow path so that a significant amount of pressure is not lost when the fluid ports 129, 140 are aligned and the drilling fluid fills the annular chamber 345. By way of example and not limitation, at least one embodiment of the pressure relief nozzle 350 may comprise a flow path of about 0.125 inch (about 3.175 mm) in diameter. In some embodiments, the pressure relief nozzle 350 may comprise a carbide flow nozzle. The size and/or number of the pressure relief nozzles 350 utilized may be selected to achieve a detectable change in standpipe pressure upon activation. For example, the utilization of a single pressure relief nozzle 350 having an opening diameter of about one-quarter (¼) inch (about 6.35 mm) may provide a change in standpipe pressure of about 80 psi (about 550 kPa). However, some sensors may be unreliable in detecting a pressure change of about 80 psi (about 550 kPa) in the standpipe. In view of this, the size and/or number of pressure relief nozzles 350 may be increased to provide a larger change in standpipe pressure and provide a reliably detectable pressure signal to alert an operator as to the operating condition of the expandable apparatus 100. For example, in some embodiments, a change in standpipe pressure greater than about 100 psi (about 690 kPa) may be reliably detectable by a pressure sensor located in the standpipe, and the size and number of pressure relief nozzles 350 may be selected to achieve a change in standpipe pressure greater than about 100 psi (about 690 kPa) upon activation. In further embodiments, a change in standpipe pressure greater than about 150 psi (about 1.03 MPa) may be reliably detectable by a pressure sensor located in the standpipe and the size and number of pressure relief nozzles 350 may be selected to achieve a change in standpipe pressure greater than about 150 psi (about 1.03 MPa) upon activation. In some embodiments, two pressure relief nozzles 350, each having an opening diameter of about one-quarter (¼) inch (about 6.35 mm) may be utilized and may provide a change in standpipe pressure of about 200 psi (about 1.38 MPa). In additional embodiments, a pressure relief nozzle 350 may be selected to have an opening diameter greater than about one-quarter (¼) inch (about 6.35 mm), such as an opening diameter of about 10/32 inch (about 8 mm) or larger.

Figure 13:
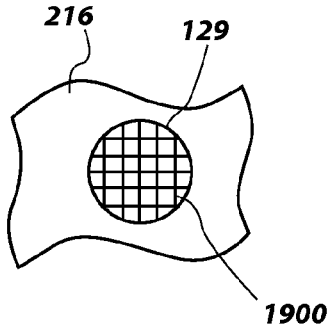
FIG. 13 shows an enlarged view of a fluid port in the valve piston of FIG. 12A-12C.

In addition to the one or more pressure relief nozzles 350, at least one high pressure release device 355 may be provided to provide pressure release should the pressure relief nozzle 350 fail (e.g., become plugged). The at least one high pressure release device 355 may comprise, for example, a backup burst disk, a high pressure check valve, or other device. The at least one high pressure release device 355 may withstand pressures up to about five thousand pounds per square inch (5000 psi). In at least some embodiments, a screen (such as similar to screen 1900 shown in FIG. 13) may be positioned over the at least one high pressure release device 355 to prevent solid debris from damaging components (e.g. such as a backup burst disc, of the at least one high pressure release device 355.

Figure 12A:
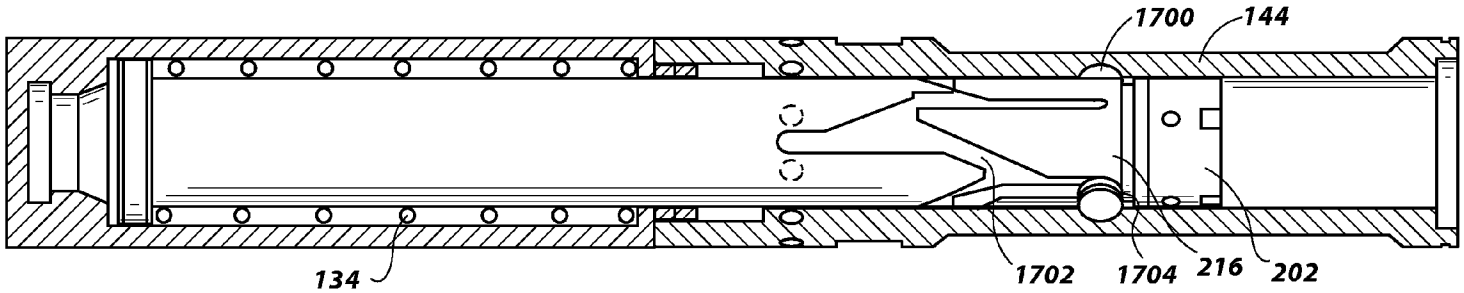
FIGS. 12A-12C show cross-sectional views of a valve piston and valve housing including a track and pin arrangement.
Figure 12B:
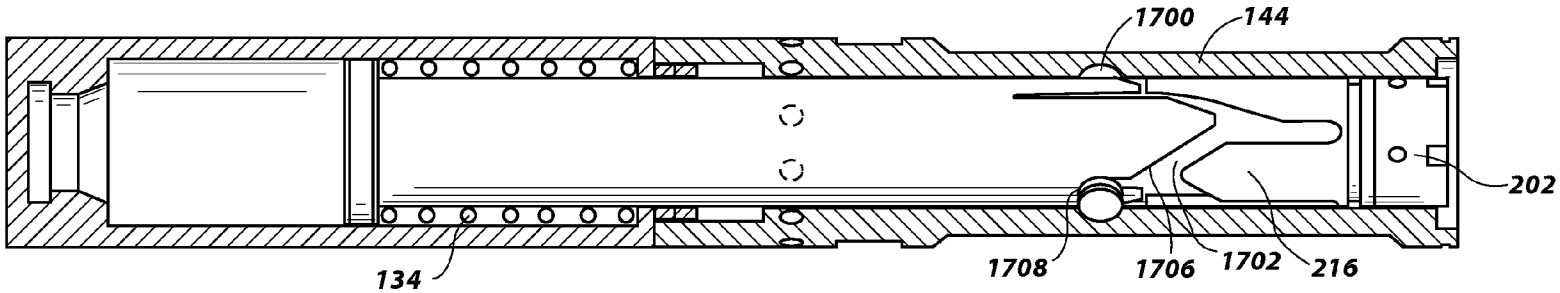
Figure 12C:
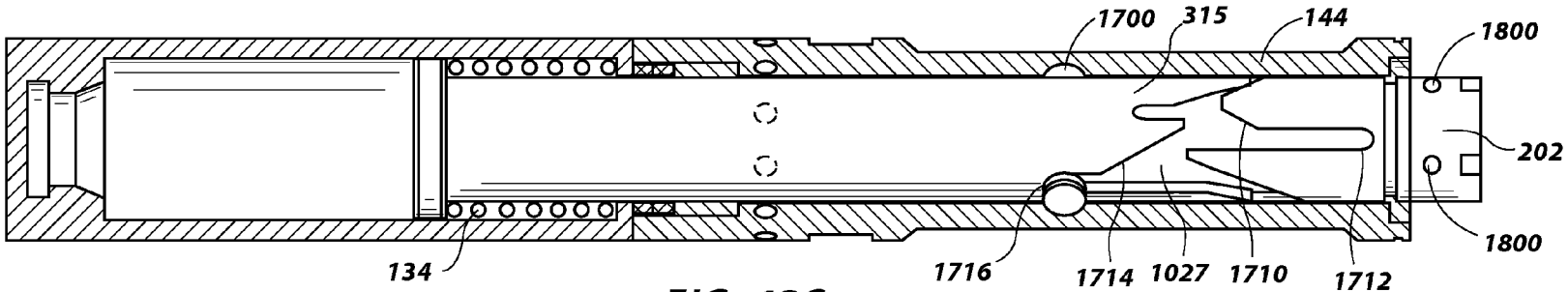

As previously discussed with reference to FIGS. 3-5, the position of the valve piston 216 may be mechanically maintained relative to the valve housing 144, such as in one of a neutral position, a locked open position and a locked closed position. FIGS. 12A-12C illustrate a pin and pin track system for such mechanical operation of the valve. The mechanically operated valve comprises the valve piston 216 and the valve housing 144, which are coupled via a pin 1700 and a pin track 1702 configuration.

For example, the valve piston 216 may comprise a pin track 1702 formed in an outer surface thereof and configured to receive one or more pins 1700 on an inner surface of the valve housing 144. Alternatively, in other embodiments, the valve piston 216 may comprise one or more pins on the outer surface thereof (not shown) and the valve housing 144 may comprise a pin track formed in an inner surface for receiving the one or more pins of the valve piston 216. In some embodiments, the pin track 1702 may have what is often referred to in the art as a "J-slot" configuration.

In operation, the valve piston 216 may be biased by the second spring 134 exerting a force in the upward direction. The valve piston 216 may be configured with at least a portion having a reduced inner diameter, such as the nozzle 202, providing a constriction to downward flow of drilling fluid. When a drilling fluid flows through the valve piston 216 and the reduced inner diameter thereof, the pressure above the constriction created by the reduced inner diameter may be sufficient to overcome the upward force exerted by the second spring 134, causing the valve piston 216 to travel downward and the second spring 134 to compress. If the flow of drilling fluid is eliminated or reduced below a selected threshold, the upward force exerted by the second spring 134 may be sufficient to move the valve piston 216 at least partially upward.

Referring to FIGS. 12A-12C, one or more pins, such as pin 1700 carried by the valve housing 144, is received by the pin track 1702. The valve piston 216 is longitudinally and rotationally guided by the engagement of one or more pins 1700 with pin track 1702. For example, when there is relatively little or no fluid flow through the valve piston 216, the force exerted by the second spring 134 biases the valve piston 216 upward and the pin 1700 rests in a first lower hooked portion 1704 of the pin track 1702, as shown in FIG. 12A. This corresponds to the neutral position of the reamer apparatus shown in FIG. 3. When drilling fluid is flowed through the valve piston 216 at a sufficient flow rate to overcome the force exerted by the second spring 134 and the valve piston 216 is biased downward, the track 1702 moves along the pin 1700 until pin 1700 comes into contact with the upper angled sidewall 1706 of the pin track 1702. Movement of the valve piston 216 continues as pin 1700 is engaged by the upper angled sidewall 1706 until the pin 1700 sits in a first upper hooked portion 1708. As the track 1702 and its upper angled sidewall 1706 is engaged by pin 1700, the valve piston 216 is forced to rotate, assuming the valve housing 144 to which the pin 1700 is attached is fixed within the tubular body 105. The axial movement of the valve piston 216 may cause one or more of the fluid ports 129 in the valve piston 216 to move in or out of alignment with one or more of the fluid ports 140 in the valve housing 144 which provides fluid communication with the annular chamber 345 (FIGS. 3-5). When the pin 1700 is in the first upper hooked portion 1708, as shown in FIG.

12B, the fluid ports 129, 140 may be misaligned. This corresponds to the locked closed position of the expandable apparatus 100 as shown in FIG. 4. In the locked closed position, the blades will be in the retracted position so long as there is a flow of fluid high enough to overcome the force of the spring 134.

In order to align the fluid ports 129, 140, according to the embodiment of FIGS. 12A-12C, the drilling fluid pressure may be reduced or eliminated, causing the valve piston 216 to move upward in response to the force of the second spring 134. As the valve piston 216 is biased upward, it moves relative to the pin 1700 carried by the valve housing 144 until the pin 1700 comes into contact with a lower angled sidewall 1710 of the pin track 1702. The lower angled sidewall 1710 continues to move along the pin 1700 until the pin 1700 sits (not shown) in a second lower hooked portion 1712. As the lower angled sidewall 1710 of the pin track 1702 moves along the pin 1700, the valve piston 216 is again forced to rotate. When the drilling fluid is again flowed and the fluid pressure is again increased, the valve piston 216 biases downward and the pin track 1702 moves along the pin 1700 until the pin 1700 comes into contact with the upper angled sidewall 1714 of the track 1705. The upper angled sidewall 1714 of track 1705 moves along the pin 1700 until the pin 1700 sits in a second upper hooked portion 1716 as shown in FIG. 12C. As the upper angled sidewall 1714 of the pin track 1702 moves with respect to pin 1700, the valve piston 216 is forced to rotate still further within the valve housing 144. This axial movement causes the fluid ports 129, 140 to align with one another, allowing drilling fluid to flow into the annular chamber 345 and sliding the push sleeve 215 as described above. This corresponds to the locked open position of the expandable apparatus 100 illustrated in FIG. 5. In the locked open position, the blades will be in the extended position so long as there is a flow of fluid high enough to overcome the force of the spring 134. The track 1705 may be capable of repeating itself once the pin 1700 has traveled around a circumference of the track 1705. Similarly, when more than one pin 1700 is utilized, each pin 1700 may have a mirrored track (i.e., radially symmetric) such that each of the neutral, locked open, and locked closed positions may be achieved.

It will be apparent that the valve as embodied according to any of the various embodiments described above may be opened and closed repeatedly by simply reducing the flow rate of the drilling fluid and again increasing the flow rate of the drilling fluid to cause the valve piston 216 to move upward and downward, resulting in the rotational and axial displacement described above due to the pin and track arrangement. Additionally, other embodiments of valves for controlling the flow of fluid to the annular chamber 345 (FIGS. 3-5) may also be used.

In view of the foregoing, expandable apparatuses of various embodiments of the disclosure may be expanded and contracted by an operator an unlimited number of times. As the condition of the expandable apparatus may change multiple times while downhole, it may be especially important to be able to reliably detect the operating condition of the expandable apparatus.

In some embodiments, as previously discussed and as shown in FIGS. 12A-12C, a nozzle 202 having a restricted cross-sectional area may be coupled to the valve piston 216. As shown in FIG. 12C, the nozzle 202 may include at least one fluid port 1800 extending through a sidewall of the nozzle 202. When the expandable apparatus 100 is in the neutral or locked closed position as shown in FIGS. 12A and 12B, the nozzle 202 is retained within the valve housing 144. Accordingly, at least substantially no fluid may pass through the at least one fluid port 1800 when the expandable apparatus 100 is in the neutral or locked closed positions. However, as shown in FIG. 12C, when the expandable apparatus 100 is in the locked open position, the nozzle 202 extends beyond an end of the valve housing 144. This allows fluid to pass through the at least one fluid port 1800 in the nozzle 202, thereby increasing an area available for fluid flow which may result in a visible pressure drop of the drilling fluid passing through the expandable apparatus 100. Accordingly, by detecting and/or monitoring variations of pressure of the drilling fluid caused by the availability of fluid flow through the at least one fluid port 1800 in the nozzle, a position of the valve piston 216 may be determined, and, hence, a position of the blades may be determined.

Figure 14A:
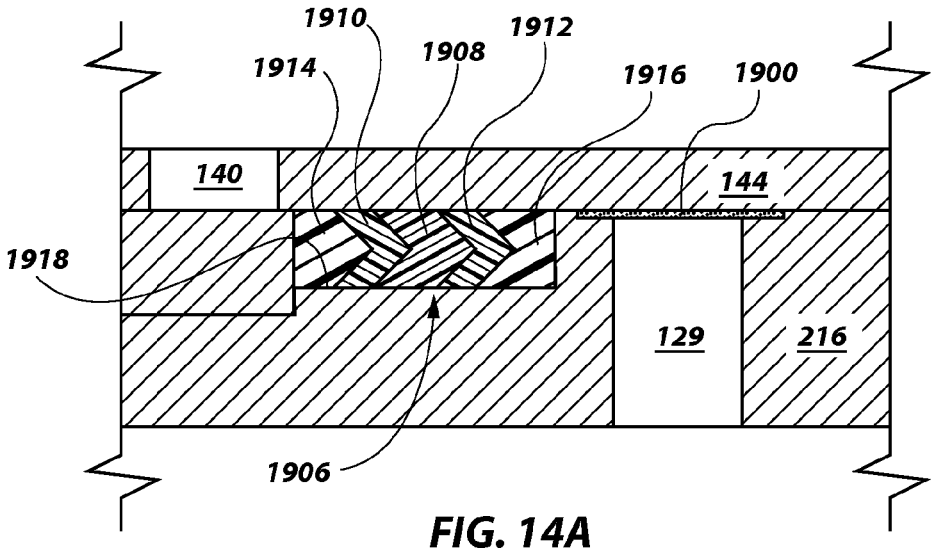
FIGS. 14A and 14B show cross-sectional detail views of a chevron seal assembly located at an interface of a valve piston and valve housing of an expandable device such as shown in FIGS. 3-5.
Figure 14B:
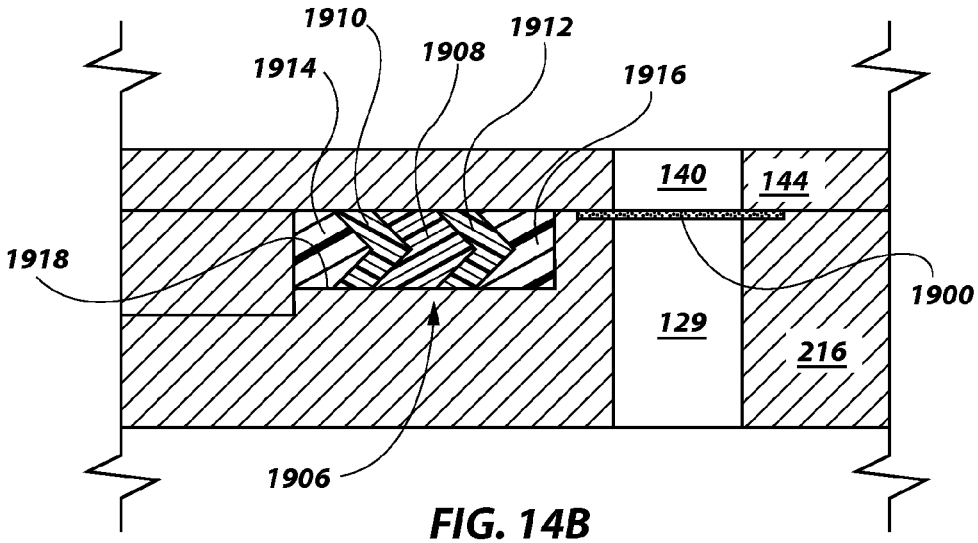

In at least some embodiments, as previously discussed, it may be desirable to prevent debris and other particles from entering the annular fluid chamber 345. Accordingly, in some embodiments, a screen 1900 may be placed over at least the at least one fluid port 129 of the valve piston 216, located between the valve piston 216 and the valve housing 144, as shown in FIGS. 14A and 14B. The screen 1900 may inhibit the flow of solid materials through the at least one fluid port 129 that may plug at least one of the at least one fluid port, the one or more pressure relief nozzles, or both. In some embodiments, the screen 1900 may comprise a cylindrical sleeve extending circumferentially around the valve piston 216.

The openings within the screen 1900 may be small enough to prevent solid debris in the drilling fluid from entering the annular chamber 345. For example, in some embodiments, the openings within the screen 1900 may have a width less than about five hundredths of an inch (0.05"). In further embodiments, the openings within the screen 1900 may have a width less than about fifteen thousandths of an inch (0.015"). During drilling, a velocity of the drilling fluid may act to clean screen 1900, preventing plugging of the screen 1900.

In some embodiments, the expandable apparatus 100 may include at least one bonded seal to prevent fluid from entering the annular chamber 345 except for when the expandable apparatus 100 is in the locked open position (see FIGS. 5 and 12C). For example, as shown in FIG. 3, a first seal 1902 and a second seal 1904 of the expandable apparatus 100 may be bonded seals. The first seal 1902 may be located between the upper portion 146 and the lower portion 148 of the valve housing 144 and provide a seal between the valve housing 144 and the valve piston 216. The second seal 1904 may be located on the nozzle 202 coupled to the valve piston 216 and provide a seal between the nozzle 202 and valve housing 144. The seals 1902, 1904 may include a metal ring or gasket having a rectangular section with at least one opening. An elastomeric ring is fit within the opening within the metal ring and bonded thereto. The disruption of the elastomeric ring is resisted by the metal ring which limits the deformation of the elastomeric ring. Conventional seals, such as plastic or O-ring seals, may be damaged or lost at pressures and conditions experienced during operation of the expandable apparatus 100. By replacing such conventional seals with bonded seals, the seals 1902, 1904 are more likely to withstand the operating conditions and pressures of the expandable apparatus 100.

In further embodiments, the expandable apparatus 100 may include at least one chevron seal, as shown in FIGS. 14A and 14B, to prevent fluid from entering the annular chamber 345 except for when the expandable apparatus 100 is in the locked open position (see FIGS. 5 and 12C). For example, a first seal 1902 and a second seal 1904 of the expandable apparatus 100 may include a chevron seal assembly 1906. The chevron seal assembly 1906 may include a chevron seal

1908, a first chevron backup ring 1910, a second chevron backup ring 1912, a first adaptor 1914, and a second adaptor 1916. The chevron seal 1908 may have a cross-section shaped generally as a chevron or "V" shape. Similarly, the first and second chevron backup rings 1910 and 1912 may have a cross-section shaped generally as a chevron or "V" shape. The first and second adaptors 1914 and 1916 may be shaped to adapt the assembled chevron seal 1908 and first and second chevron backup rings 1910 and 1912 to fit snugly in a seal gland 1918. By replacing such conventional seals with chevron seals, the seals 1902, 1904 are more likely to withstand the operating conditions and pressures of the expandable apparatus 100. As shown in FIG. 14A, when the fluid port 129 is located on a first side of the chevron seal assembly 1906 the chevron seal assembly 1906 may prevent fluid communication between the fluid port 129 of the valve piston 216 and the fluid port 140 of the valve housing 144. As shown in FIG. 14B, when the fluid port 129 travels past the chevron seal assembly 1906 the fluid ports 129 and 140 may be aligned and in fluid communication. When the fluid port 129 of the valve piston moves past the chevron seal assembly 1906, the fluid within the fluid port 129 may be under pressure and the chevron seal assembly 1906 may be exposed to this pressurized fluid. Chevron seal assemblies 1906 may provide a reliable seal in such a location and may have an improved seal life relative to conventional seals.

Figure 15:
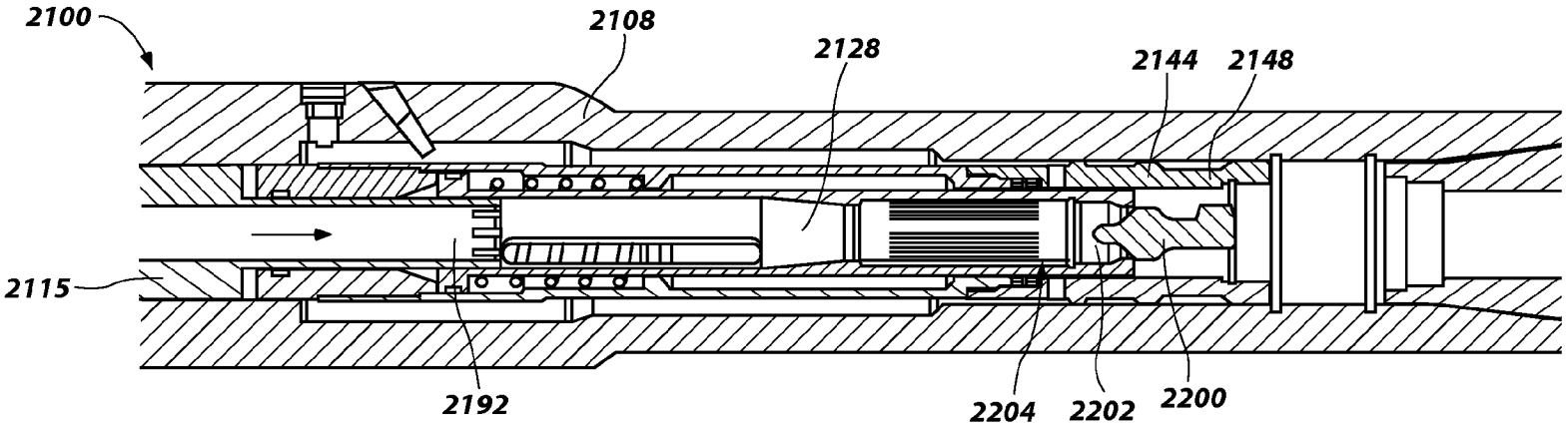
FIG. 15 shows an enlarged cross-sectional view of a bottom portion of an expandable apparatus, such as shown in FIGS. 1-5, including a status indicator and in a retracted configuration.
Figure 16:
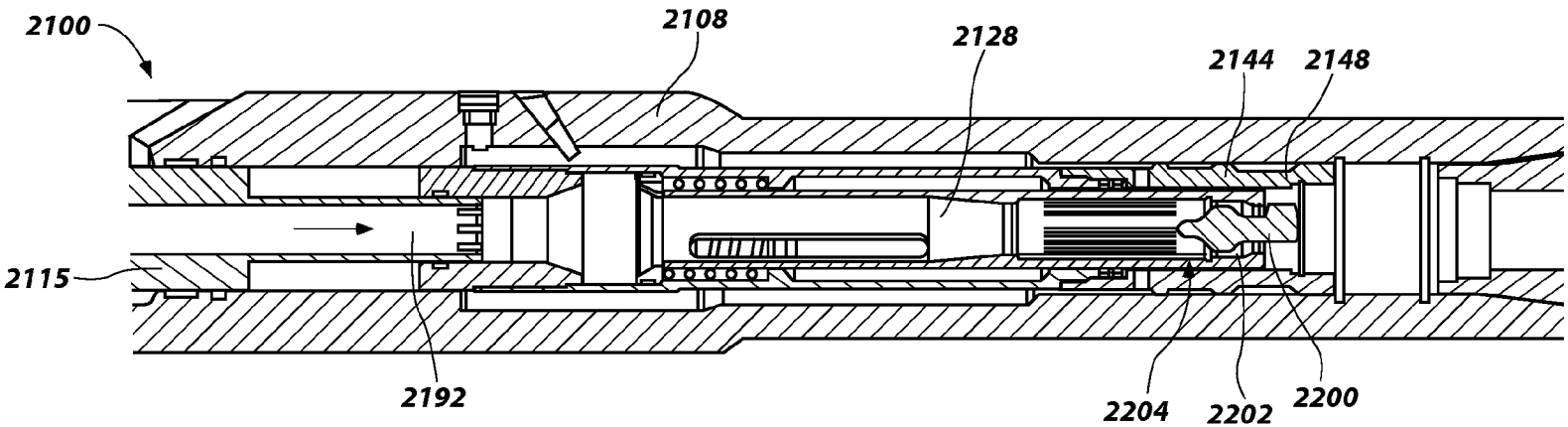
FIG. 16 shows an enlarged cross-sectional view of the bottom portion of the expandable apparatus shown in FIG. 15 when the expandable reamer apparatus is in an extended configuration.

FIG. 15 is an enlarged view of the bottom portion 12 of an expandable apparatus 2100 according to an additional embodiment, which includes a status indicator 2200 to facilitate the remote detection of the operating condition of the expandable apparatus 2100. As shown in FIGS. 15 and 16, the valve piston 2128 may include a nozzle 2202 coupled to a bottom end 2204 of the valve piston 2128. While the following examples refer to a position of the nozzle 2202 within the tubular body 2108, it is understood that in some embodiments the nozzle 2202 may be omitted. For example, in some embodiments, a status indicator 2200, as described in detail herein, may be used to generate a signal indicative of a position of a bottom end 2204 of the valve piston 2128 relative to the status indicator 2200. For example, the signal may comprise a pressure signal in the form of, for example, a detectable or measurable pressure or change in pressure of drilling fluid within the standpipe. As shown in FIG. 15, the status indicator 2200 may be coupled to the lower portion 2148 of the valve housing 2144. The status indicator 2200 is configured to indicate the position of the nozzle 2202 relative to the status indicator 2200 to persons operating the drilling system. Because the nozzle 2202 is coupled to the valve piston 2128, the position of the nozzle 2202 also indicates the position of the valve piston 2128 and, thereby, the intended and expected positions of push sleeve 2115 and the blades 120, 125, 130 (FIG. 2). If the status indicator 2200 indicates that the nozzle 2202 is not over the status indicator 2200, as shown in FIG. 15, then the status indicator 2200 effectively indicates that the blades are, or at least should be, retracted. If the status indicator 2200 indicates that the nozzle 2202 is over the status indicator 2200, as shown in FIG. 16, then the status indicator 2200 effectively indicates that the expandable apparatus 2100 is in an extended position.

Figure 17:
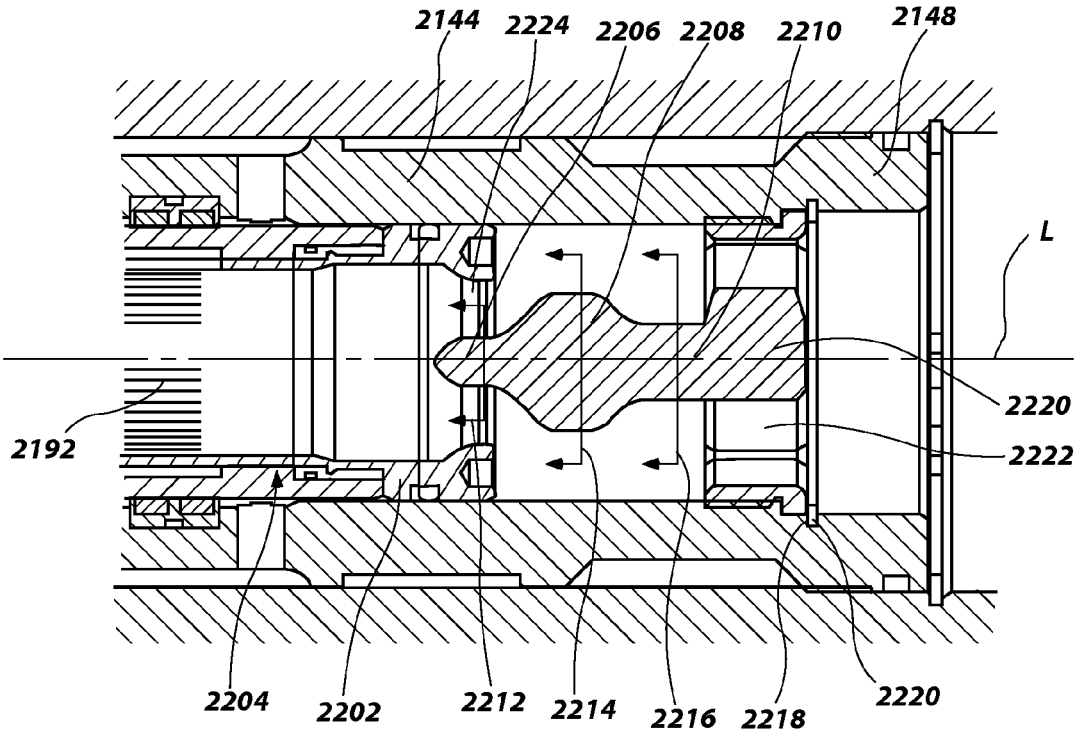
FIG. 17 shows an enlarged cross-sectional view of the status indicator as shown in FIG. 15.
Figure 19:
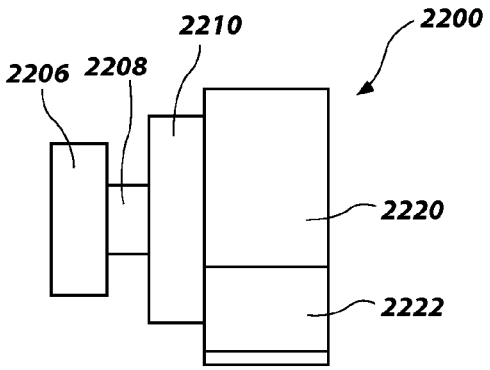
FIGS. 19-23 show longitudinal side views of additional embodiments of status indicators.
Figure 20:
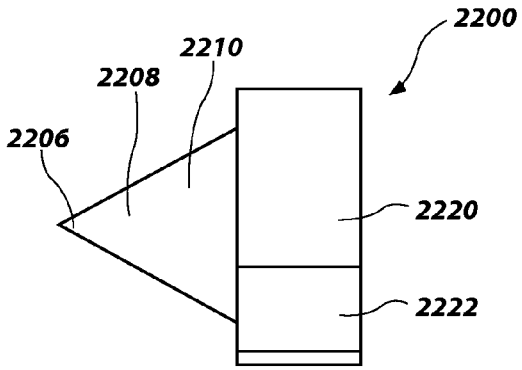
Figure 21:
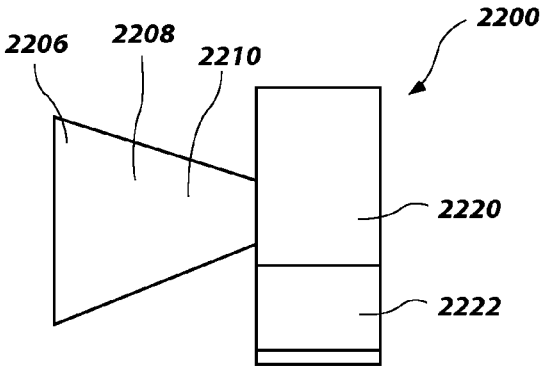
Figure 22:
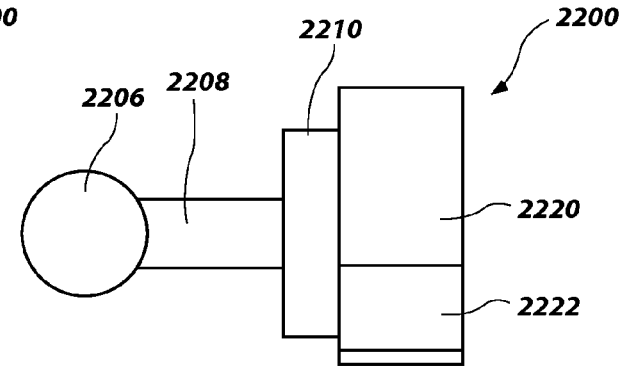

FIG. 17 is an enlarged view of one embodiment of the status indicator 2200 when the expandable apparatus 2100 is in the closed position. In some embodiments, the status indicator 2200 includes at least two portions, each portion of the at least two portions having a different cross-sectional area in a plane perpendicular to the longitudinal axis L. For example, in one embodiment, as illustrated in FIG. 17, the status indicator 2200 includes a first portion 2206 having a first cross-sectional area 2212, a second portion 2208 having a second cross-sectional area 2214, and a third portion 2210 having a third cross-sectional area 2216. As shown in FIG. 17, the first cross-sectional area 2212 is smaller than the second cross-sectional area 2214, the second cross-sectional area 2214 is larger than the third cross-sectional area 2216, and the third cross-sectional area 2216 is larger than the first cross-sectional area 2212. The different cross-sectional areas 2212, 2214, 2216 of the status indicator 2200 of FIG. 17 are non-limiting examples, any combination of differing cross-sectional areas may be used. For example, in the status indicator 2200 having three portions 2206, 2208, 2210, as illustrated in FIG. 17, additional embodiments of the following relative cross-sectional areas may include: the first cross-sectional area 2212 may be larger than the second cross-sectional area 2214 and the second cross-sectional area 2214 may be smaller than the third cross-sectional area 2216 (see, e.g., FIG. 19); the first cross-sectional area 2212 may be smaller than the second cross-sectional area 2214 and the second cross sectional area 2214 may be smaller than the third cross-sectional area 2216 (see, e.g., FIG. 20); the first cross-sectional area 2212 may be larger than the second cross-sectional area 2214 and the second cross sectional area 2214 may be larger than the third cross-sectional area 2216 (see, e.g., FIG. 21). In addition, the transition between cross-sectional areas 2212, 2214, 2216 may be gradual as shown in FIG. 17, or the transition between cross-sectional areas 2212, 2214, 2216 may be abrupt as shown in FIG. 19. A length of each portion 2206, 2208, 2210 (in a direction parallel to the longitudinal axis L (FIG. 1)) may be substantially equal as shown in FIGS. 19-21, or the portions 2206, 2208, 2210 may have different lengths as shown in FIG. 22. The embodiments of status indicators 2200 shown in FIGS. 17 and 19-22 are non-limiting examples, and any geometry or configuration having at least two different cross-sectional areas may be used to form the status indicator 2200.

Figure 23:
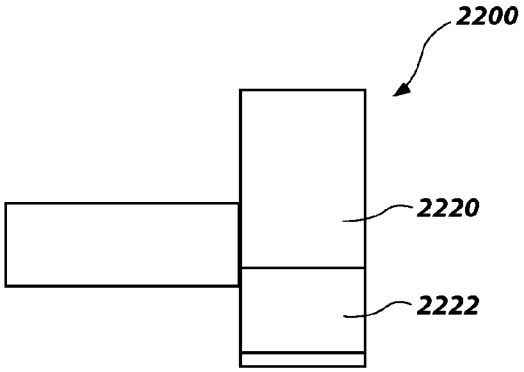

In further embodiments, the status indicator 2200 may comprise only one cross-sectional area, such as a rod as illustrated in FIG. 23. If the status indicator 2200 comprises a single cross-sectional area, the status indicator 2200 may be completely outside of the nozzle 2202 when the valve piston 2128 is in the initial proximal position and the blades are in the retracted positions.

Continuing to refer to FIG. 17, the status indicator 2200 may also include a base 2220. The base 2220 may include a plurality of fluid passageways 2222 in the form of holes or slots extending through the base 2220, which allow the drilling fluid to pass longitudinally through the base 2220. The base 2220 of the status indicator 2200 may be attached to the lower portion 2148 of the valve housing 2144 in such a manner as to fix the status indicator 2200 at a location relative to the valve housing 2144. In some embodiments, the base 2220 of the status indicator may be removably coupled to the lower portion 2148 of the valve housing 2144. For example, each of the base 2220 of the status indicator 2200 and the lower portion 2148 of the valve housing 2144 may include a complementary set of threads (not shown) for connecting the status indicator 2200 to the lower portion 2148 of the valve housing 2144. In some embodiments, the lower portion 2148 may comprise an annular recess 2218 configured to receive an annular protrusion formed on the base 2220 of the status indicator 2200. At least one of the status indicator 2200 and the lower portion 2148 of the valve housing 2144 may be formed of an erosion resistant material. For example, in some embodiments, the status indicator 2200 may comprise a hard material, such as a carbide material (e.g., a cobalt-cemented tungsten carbide material), or a nitrided or case hardened steel.

Figure 18:
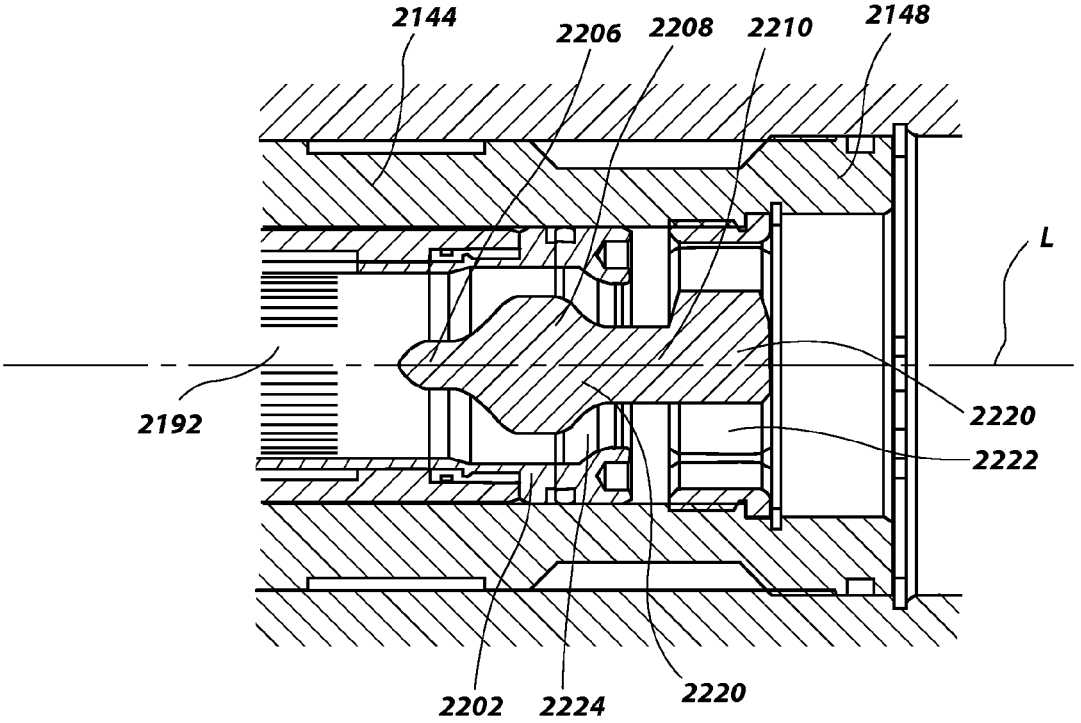
FIG. 18 shows an enlarged cross-sectional view of the status indicator as shown in FIG. 16.

The nozzle 2202 may be configured to pass over the status indicator 2200 as the valve piston 2128 moves from the initial proximal position into a different distal position to cause extension of the blades. FIG. 18 illustrates the nozzle 2202 over the status indicator 2200 when the valve piston 2128 is in the distal position for extension of the blades. In some embodiments, the fluid passageway 2192 extending through the nozzle 2202 may have a uniform cross-section. Alternatively, as shown in FIGS. 17 and 18, the nozzle 2202 may include a protrusion 2224 which is a minimum cross-sectional area of the fluid passageway 2192 extending through the nozzle 2202.

In operation, as fluid is pumped through the internal fluid passageway 2192 extending through the nozzle 2202, a pressure of the drilling fluid within the drill string or the bottom hole assembly (e.g., within the reamer apparatus 2100) may be measured and monitored by personnel or equipment operating the drilling system. As the valve piston 2128 moves from the initial proximal position to the subsequent distal position, the nozzle will move over at least a portion of the status indicator 2200, which will cause the fluid pressure of the drilling fluid being monitored to vary. These variances in the pressure of the drilling fluid can be used to determine the relationship of the nozzle 2202 to the status indicator 2200, which, in turn, indicates whether the valve piston 2128 is in the proximal position or the distal position, and whether the blades should be in the retracted position or the extended position.

For example, as shown in FIG. 17, the first portion 2206 of the status indicator 2200 may be disposed within nozzle 2202 when the valve piston 2128 is in the initial proximal position. The pressure of the fluid traveling through the internal fluid passageway 2192 may be a function of the minimum cross-sectional area of the fluid passageway 2192 through which the drilling fluid is flowing through the nozzle 2102. In other words, as the fluid flows through the nozzle 2102, the fluid must pass through an annular-shaped space defined by the inner surface of the nozzle 2202 and the outer surface of the status indicator 2200. This annular-shaped space may have a minimum cross-sectional area equal to the minimum of the difference between the cross-sectional area of the fluid passageway 2192 through the nozzle 2202 and the cross-sectional area of the status indicator 2200 disposed within the nozzle 202 (in a common plane transverse to the longitudinal axis L). Because the cross sectional area 2214 of the second portion 2208 of the status indicator 2200 differs from the cross-sectional area 2212 of the first portion 2206, the pressure of the drilling fluid will change as the nozzle 2202 passes from the first portion 2206 to the second portion 2208 of the status indicator 2200. Similarly, because the cross sectional area 2214 of the second portion 2208 of the status indicator 2200 differs from the cross-sectional area 2216 of the third portion 2210 of the status indicator 2200, the pressure of the drilling fluid will change as the nozzle 2202 passes from the second portion 2208 to the third portion 2210.

Figure 24:
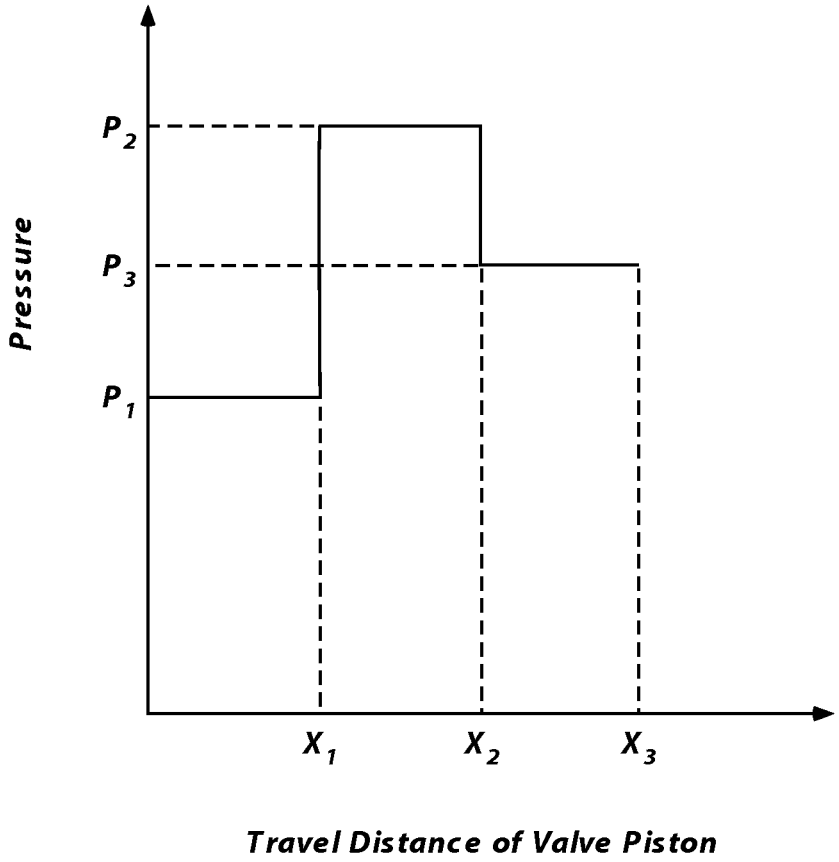
FIG. 24 shows a simplified graph of a pressure of drilling fluid within a valve piston as a function of a distance by which the valve piston travels relative to a status indicator.

FIG. 24 is a simplified graph of the pressure P of drilling fluid within the valve piston 2128 as a function of a distance X by which the valve piston 2128 travels as it moves from the initial proximal position to the subsequent distal position while the drilling fluid is flowing through the valve piston 2128. With continued reference to FIG. 24, for the status indicator 2200 illustrated in FIGS. 17 and 18, a first pressure $P_1$ may be observed the first portion 2206 of the status indicator 2200 is within the nozzle 2202 as shown in FIG. 17. As the expandable apparatus 2100 moves from the closed to the open position valve piston 2128 moves from the initial proximal position shown in FIG. 17 to the subsequent distal position shown in FIG. 18, a visible pressure spike corresponding to a second pressure $P_2$ will be observed as the protrusion 2224 of the nozzle 2202 passes over the second portion 2208 of the status indicator 2200. For example, when the valve piston 2128 has traveled a first distance $X_1$, the protrusion 2224 will reach the transition between the first portion 2206 and the second portion 2208 of the status indicator 2200, and the pressure will then increase from the first pressure $P_1$ to an elevated pressure $P_2$, which is higher than $P_1$. When the valve piston 2128 has traveled a second, farther distance X, the protrusion 2224 will reach the transition between the second portion 2208 and the third portion 2210 of the status indicator 2200, and the pressure will then decrease from the second pressure $P_2$ to a lower pressure $P_3$, which is lower than $P_2$. The third pressure P3 may be higher than the first pressure P in some embodiments of the invention, although the third pressure $P_3$ could be equal to or less than the first pressure $P_1$ in additional embodiments of the invention. By detecting and/or monitoring the variations in the pressure within the valve piston 2128 (or at other locations within the drill string or bottom hole assembly) caused by relative movement between the nozzle 2202 and the status indicator 2200, the position of the valve piston 2128 may be determined, and, hence, the position of the blades may be determined.

For example, in one embodiment, the status indicator 2200 may be at least substantially cylindrical. The second portion 2208 may have a diameter about equal to about three times a diameter of the first portion 2206 and the third portion 2210 may have a diameter about equal to about the diameter of the first portion 2206. For example, in one embodiment, as illustrative only, the first portion 2206 may have a diameter of about one half inch (0.5"), the second portion 2208 may have a diameter of about one and forty-seven hundredths of an inch (1.47") and the third portion 2210 may have a diameter of about eight tenths of an inch (0.80"). At an initial fluid flow rate of about six hundred gallons per minute (600 gpm) for a given fluid density, the first portion 2206 within the nozzle 2202 generates a first pressure drop across the nozzle 2202 and the status indicator 2200. In some embodiments, the first pressure drop may be less than about 100 psi. The fluid flow rate may then be increased to about eight hundred gallons per minute (800 gpm), which generates a second pressure drop across the nozzle 2202 and the status indicator 2200. The second pressure drop may be greater than about one hundred pounds per square inch (100 psi), for example, the second pressure drop may be about one hundred and thirty pounds per square inch (130 psi). At 800 gpm, the valve piston 2128 begins to move toward the distal end 2190 (FIG. 15) of the expandable apparatus 2100 causing the protrusion 2224 of the nozzle 2202 to pass over the status indicator 2200. As the protrusion 2224 of the nozzle 2202 passes over the second portion 2208 of the status indicator 2200, the cross-sectional area available for fluid flow dramatically decreases, causing a noticeable spike in the pressure drop across the nozzle 2202 and the status indicator 2200. The magnitude of the pressure drop may peak at, for example, about 500 psi or more, about 750 psi or more, or even about 1,000 psi or more (e.g., about one thousand two hundred and seventy-three pounds per square inch (1273 psi)). As the protrusion 2224 of the nozzle 2202 continues to a position over the third portion 2210 of the status indicator 2200, the pressure drop may decrease to a third pressure drop. The third pressure drop may be greater than the second pressure drop but less than the pressure peak.

For example, the third pressure drop may be about one hundred fifty pounds per square inch (150 psi).

As previously mentioned, in some embodiments, the status indicator 2200 may include a single uniform cross-sectional area as shown in FIG. 23. In this embodiment, only a single increase in pressure may be observed as the nozzle 2202 passes over the status indicator 2200. Accordingly, the more variations in cross-sectional area the status indicator 2200, such as two or more cross-sectional areas, the greater the accuracy of location of the nozzle 2202 that may be determined.

In yet further embodiments, the status indicator 2200 may completely close the nozzle 2202 and prevent fluid flow through the nozzle 2202 at the conclusion of the when valve piston is in the distal position and the blades 120, 125, 130 (FIG. 2) have been moved to a fully expanded position. In view of this, a significant increase in the standpipe pressure may be achieved and a specific pressure, or a change in pressure, may then be detected to signal to an operator that the blades 120, 125, 130 have moved to an expanded position. For example, the status indicator may be configured generally as shown in FIG. 19 and may have a third portion 2210 having a shape sized and shaped to seal the nozzle 2202 when the nozzle 2202 extends over the third portion 2210. After the blades 120, 125, 130 of the expandable apparatus 2100 have moved to an expanded position and the nozzle 2202 has been closed, the increase in pressure will be detected by a pressure sensor and the operator may be alerted and may then adjust the fluid flow to achieve an appropriate operating pressure.

Furthermore, although the expandable apparatus described herein includes a valve piston, the status indicator 2200 may also be used in other expandable apparatuses as known in the art.

Although the forgoing disclosure illustrates embodiments of an expandable apparatus comprising an expandable reamer apparatus, the disclosure is not so limited. For example, in accordance with other embodiments of the disclosure, the expandable apparatus may comprise an expandable stabilizer, wherein the one or more expandable features may comprise stabilizer blocks. Thus, while certain embodiments have been described and shown in the accompanying drawings, such embodiments are merely illustrative and not restrictive of the scope of the invention, and this invention is not limited to the specific constructions and arrangements shown and described, since various other additions and modifications to, and deletions from, the described embodiments will be apparent to one of ordinary skill in the art.

Additionally, features from embodiments of the disclosure may be combined with features of other embodiments of the disclosure and may also be combined with and included in other expandable devices. The scope of the invention is, accordingly, limited only by the claims which follow herein, and legal equivalents thereof.

What is claimed is:

1. An expandable apparatus, comprising:

a tubular body comprising a fluid passageway extending therethrough and first nozzles extending through the tubular body;

a valve housing disposed within the tubular body, the valve housing comprising a fluid port opening into an annular chamber disposed between the valve housing and the tubular body;

a valve piston disposed within the valve housing, the valve piston comprising a surface configured to move the valve piston axially responsive to drilling fluid pressure and a second nozzle configured to selectively align and misalign with the port of the valve housing, the valve piston configured to move axially relative to the tubular body from a first, neutral position to a second, locked open position responsive to a pressure of drilling fluid passing through the fluid passageway to exert a force on the surface, wherein the second nozzle is misaligned with the fluid port when the valve piston is in the first, neutral position and the second nozzle is aligned with the fluid port when the valve piston is in the second, locked open position; and a push sleeve disposed within the tubular body and coupled to at least one expandable feature, the push sleeve configured to move axially responsive to the flow of fluid into the annular chamber and extend the at least one expandable feature, the push sleeve comprising nozzle ports extending through the push sleeve to provide fluid communication with the first nozzles, wherein the first nozzles and the nozzle ports are always open, wherein the at least one expandable feature is in a retracted position when the valve piston is in the first, neutral position and is movable to an extended position when the valve piston is in the second, locked open position.

2. The expandable apparatus of claim 1, wherein the second nozzle comprises at least one fluid aperture extending through a sidewall of the valve piston.

3. The expandable apparatus of claim 2 further comprising at least one screen extending over the at least one fluid aperture of the valve piston.

4. The expandable apparatus of claim 1, wherein the expandable apparatus comprises at least one of a bonded seal and a chevron seal.

5. The expandable apparatus of claim 1, wherein the annular chamber comprises at least one bleed nozzle or check valve, wherein the at least one bleed nozzle or check valve is always open.

6. The expandable apparatus of claim 1, wherein the valve piston is further configured to move axially relative to the tubular body from the second, locked open position to a third, locked closed position between the first, neutral position and the second, locked open position, and wherein the at least one expandable feature is in the retracted position when the valve piston is in the third, locked closed position.

7. The expandable apparatus of claim 1, further comprising at least one biasing element configured and disposed to exert an axial bias force on the valve piston.

8. The expandable apparatus of claim 7, wherein the valve piston is coupled to the valve housing by at least one pin carried by one of the valve piston and the valve housing, the at least one pin engaged with a track located in the other of the valve piston and the valve housing, the at least one pin and the track, in combination, configured to control rotational and axial movement of the valve piston within and relative to the valve housing responsive to the upward bias force of the biasing element and selected application of an axial, downward force provided by drilling fluid flow through the fluid passageway of the valve piston.

9. A method of operating an expandable apparatus, comprising:

positioning an expandable apparatus in a borehole;

directing a fluid flow through a fluid passageway of a tubular body of the expandable apparatus, wherein a valve housing is disposed within the tubular body to define an annular chamber between the valve housing and the tubular body;

moving a valve piston within the valve housing axially relative to the tubular body from a first, neutral position to a second, locked open position in response to fluid flow exerting a force against a surface of the valve piston to unobstruct a fluid port in the valve housing;

aligning a first nozzle of the valve piston with the fluid port of the valve housing responsive to moving the valve piston;

directing at least a portion of the fluid flow aligning the first nozzle and the fluid port into the annular chamber;

moving a push sleeve axially relative to the tubular body with the fluid flow directed into the annular chamber between the valve housing and the tubular body;

extending at least one expandable feature coupled to the push sleeve in response to movement of the push sleeve; and directing a fluid flow through nozzle ports extending through the push sleeve to second nozzles extending through the tubular body when the at least one expandable feature is extended and when the at least one expandable feature is retracted.

10. The method of claim 9, wherein directing the at least a portion of the fluid flow through the first nozzle and the fluid port into the annular chamber comprises directing the fluid flow through the first nozzle comprising at least one aperture extending through a sidewall of the valve piston, the fluid port extending through a sidewall of the valve housing into the annular chamber.

11. The method of claim 10, further comprising directing the fluid flow through the at least one fluid aperture when the at least one expandable feature is extended.

12. The method of claim 11, further comprising directing the fluid flow through at least one screen extending over the at least one aperture.

13. The method of claim 9, further comprising providing a seal between the valve piston and the tubular body with at least one of a bonded seal and a chevron seal.

14. The method of claim 9, further comprising directing a fluid flow from the annular chamber through at least one bleed nozzle or check valve.

15. The method of claim 9, further comprising moving the valve piston from the second, locked open position to a third, locked closed position between the first, neutral position and the second, locked open position, wherein the at least one expandable feature is in a retracted position when the valve piston is in the third, locked closed position.

16. The method of claim 9, further comprising exerting an axial bias force on the valve piston.

17. The method of claim 9, further comprising repeatedly extending and retracting the at least one expandable feature while the expandable apparatus is in the borehole.

* * * * *